US011340540B2

(12) United States Patent
Takei et al.

(10) Patent No.: US 11,340,540 B2
(45) Date of Patent: May 24, 2022

(54) IMAGE FORMING APPARATUS AND IMAGE FORMING METHOD

(71) Applicant: RICOH COMPANY, LTD., Tokyo (JP)

(72) Inventors: Akio Takei, Shizuoka (JP); Daisuke Inoue, Shizuoka (JP); Daichi Hisakuni, Shizuoka (JP); Hidetaka Kubo, Kanagawa (JP); Masahiro Ohmori, Kanagawa (JP); Junichi Awamura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 183 days.

(21) Appl. No.: 16/961,093

(22) PCT Filed: Dec. 21, 2018

(86) PCT No.: PCT/JP2018/047160
§ 371 (c)(1),
(2) Date: Jul. 9, 2020

(87) PCT Pub. No.: WO2019/133845
PCT Pub. Date: Jul. 18, 2019

(65) Prior Publication Data

US 2021/0063916 A1 Mar. 4, 2021

(30) Foreign Application Priority Data

Jan. 11, 2018 (JP) ..... JP2018-002358

(51) Int. Cl.
*G03G 15/16* (2006.01)
*G03G 9/08* (2006.01)

(52) U.S. Cl.
CPC ..... *G03G 15/162* (2013.01); *G03G 9/0804* (2013.01); *G03G 9/0819* (2013.01); *G03G 9/0823* (2013.01); *G03G 9/0827* (2013.01)

(58) Field of Classification Search
CPC ..... G03G 15/162; G03G 2215/1623; G03G 9/0823
See application file for complete search history.

(56) References Cited

U.S. PATENT DOCUMENTS 5,212,038 A 5/1993 Watanabe et al.
5,663,788 A * 9/1997 Sanpe ..... G03G 21/0035 399/353

(Continued)

FOREIGN PATENT DOCUMENTS

EP 0414442 A1 2/1991
EP 3179312 A2 6/2017

(Continued)

OTHER PUBLICATIONS

Japanese Office Action dated Oct. 12, 2021 in Japanese Application No. 2018-002358, with English translation, 6 pages.

(Continued)

*Primary Examiner* — Thomas S Giampaolo, II
(74) *Attorney, Agent, or Firm* — Grüneberg and Myers PLLC

(57) ABSTRACT

Provided is an image forming apparatus including an image bearer, a developing unit configured to develop with a toner, an intermediate transfer member, and a transferring unit, wherein the intermediate transfer member is a laminate including a base layer and an elastic layer including particles at a surface thereof to form convex-concave shapes at the surface, the particles have volume resistivity of from $1\times10^{0}$ ohm*cm through $1\times10^{9}$ ohm*cm, the toner includes additive, an amount of the additive separated from the toner is from 20 percent by mass through 35 percent by mass relative to a total amount of the additive in the toner when a toner dispersion liquid in which the toner is dispersed in a dispersant is irradiated with ultrasonic wave vibration with an (Continued)

irradiation energy dose of 4 kJ, and the toner has a dielectric constant of 2.6 or greater but 3.9 or less.

15 Claims, 3 Drawing Sheets

(56) References Cited

U.S. PATENT DOCUMENTS

| | | | |
|---|---|---|---|
| 5,666,193 | A | 9/1997 | Rimai et al. |
| 9,069,288 | B2 | 6/2015 | Kojima et al. |
| 9,152,084 | B2 | 10/2015 | Shiba et al. |
| 9,229,375 | B2 | 1/2016 | Kubo et al. |
| 9,507,296 | B2 | 11/2016 | Kubo et al. |
| 2002/0064720 | A1 | 5/2002 | Tsutsumi et al. |
| 2002/0067934 | A1 | 6/2002 | Jia et al. |
| 2013/0196261 | A1 | 8/2013 | Uchinokura et al. |
| 2013/0244155 | A1 | 9/2013 | Satoh et al. |
| 2013/0244156 | A1 | 9/2013 | Kojima et al. |
| 2013/0244158 | A1 | 9/2013 | Awamura et al. |
| 2014/0220485 | A1 | 8/2014 | Kojima et al. |
| 2014/0234767 | A1 | 8/2014 | Awamura et al. |
| 2016/0004192 | A1 | 1/2016 | Itoh et al. |
| 2016/0195826 | A1 | 7/2016 | Kimura et al. |
| 2016/0195827 | A1 | 7/2016 | Murayama et al. |
| 2016/0195828 | A1 | 7/2016 | Satoh et al. |
| 2016/0266507 | A1 | 9/2016 | Watanabe et al. |
| 2016/0334722 | A1 | 11/2016 | Makabe et al. |
| 2016/0378006 | A1 | 12/2016 | Itoh et al. |
| 2017/0168405 | A1 | 6/2017 | Uchida et al. |
| 2017/0269513 | A1 | 9/2017 | Kubo et al. |
| 2017/0285502 | A1 | 10/2017 | Fujisaki et al. |
| 2017/0315460 | A1 | 11/2017 | Tanabe et al. |
| 2018/0052403 | A1 | 2/2018 | Inoue et al. |
| 2018/0224763 | A1 | 8/2018 | Tanaka et al. |
| 2018/0253022 | A1 | 9/2018 | Takeda et al. |
| 2018/0267435 | A1 | 9/2018 | Kubo |
| 2021/0173337 | A1* | 6/2021 | Inoue ..... G03G 9/0819 |

FOREIGN PATENT DOCUMENTS

| | | |
|---|---|---|
| JP | 09-034159 | 2/1997 |
| JP | 09-230717 | 9/1997 |
| JP | 2002-162767 | 6/2002 |
| JP | 2004-053918 | 2/2004 |
| JP | 2004-354716 | 12/2004 |
| JP | 2006-003499 | 1/2006 |
| JP | 2007-328165 | 12/2007 |
| JP | 2008-233511 | 10/2008 |
| JP | 2009-075154 | 4/2009 |
| JP | 2011-043759 | 3/2011 |
| JP | 2012-194223 | 10/2012 |
| JP | 2014145817 | 8/2014 |
| JP | 2014-170118 | 9/2014 |
| JP | 2015-148660 | 8/2015 |
| JP | 5786181 | 8/2015 |
| JP | 2016014707 | 1/2016 |
| JP | 2017181743 | 10/2017 |
| JP | 2017198946 | 11/2017 |
| JP | 2018-155953 | 10/2018 |

OTHER PUBLICATIONS

International Search Report dated Mar. 1, 2019 for counterpart International Patent Application No. PCT/JP2018/047160 filed Dec. 21, 2018.

Written Opinion dated Mar. 1, 2019 for counterpart International Patent Application No. PCT/JP2018/047160 filed Dec. 21, 2018.

* cited by examiner

[Fig. 1]
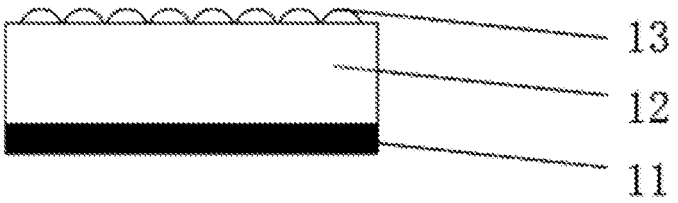
[Fig. 2A]
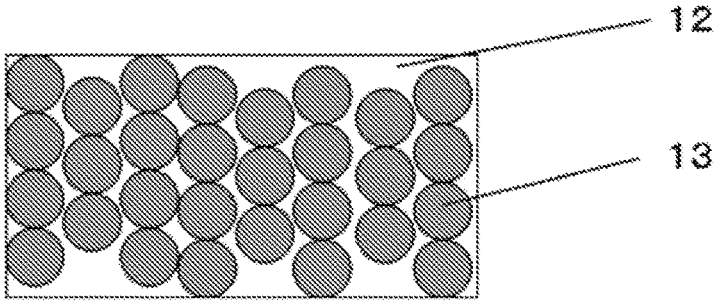
[Fig. 2B]
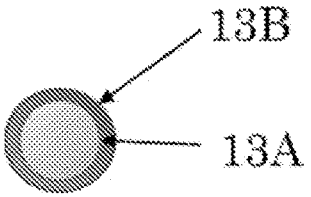
[Fig. 3]
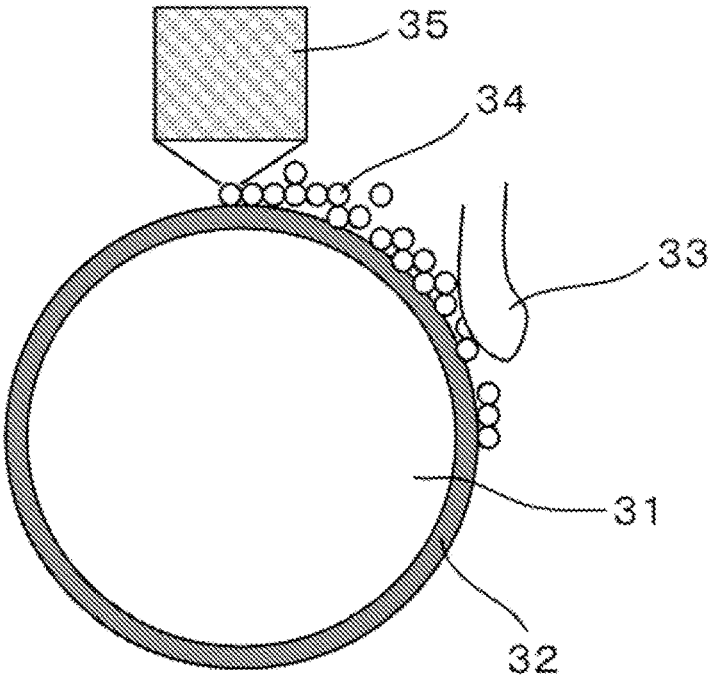

[Fig. 4]
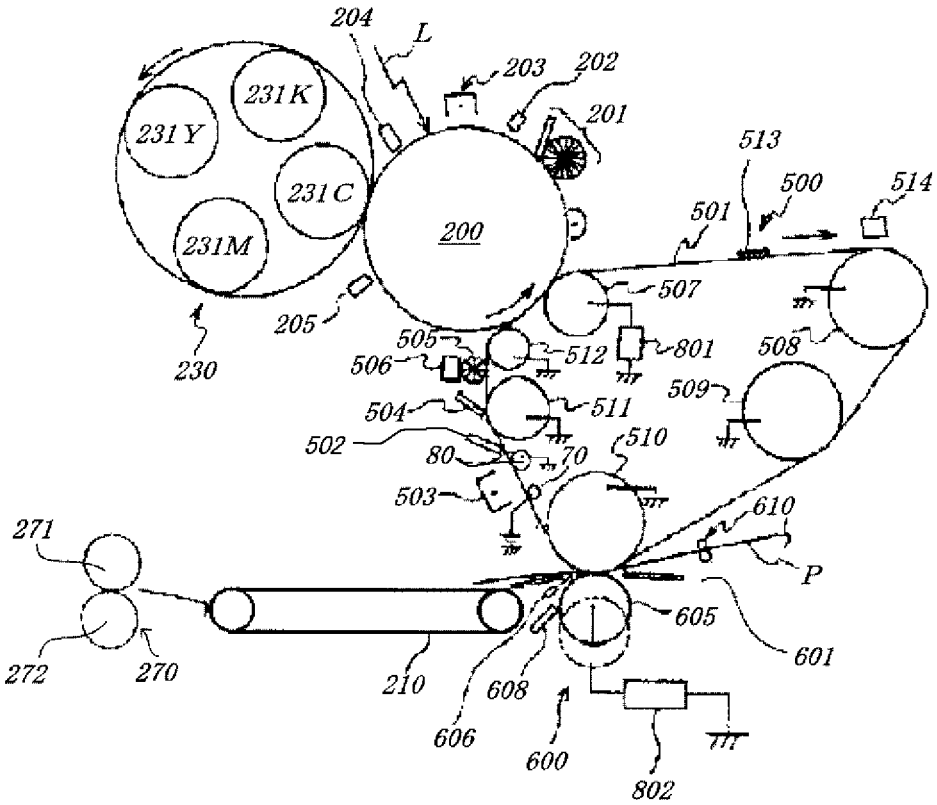
[Fig. 5]
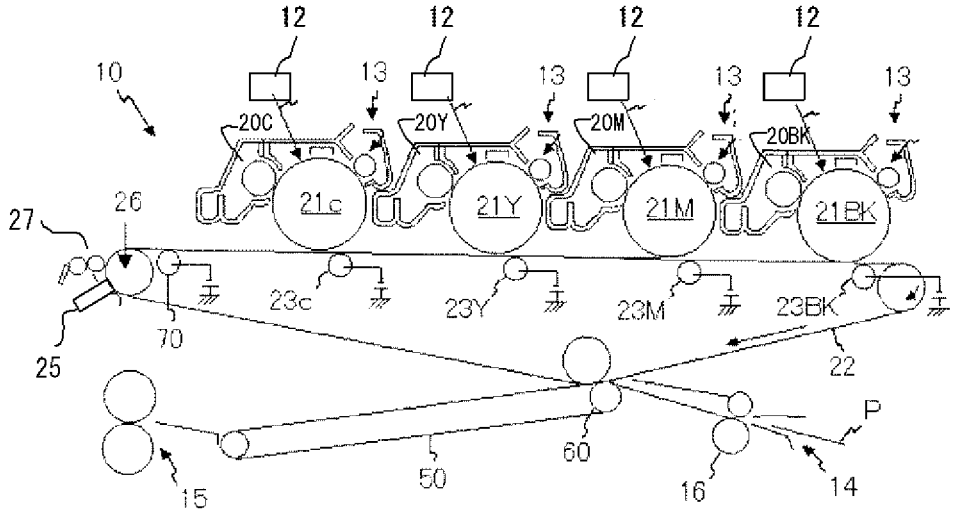

[Fig. 6A]
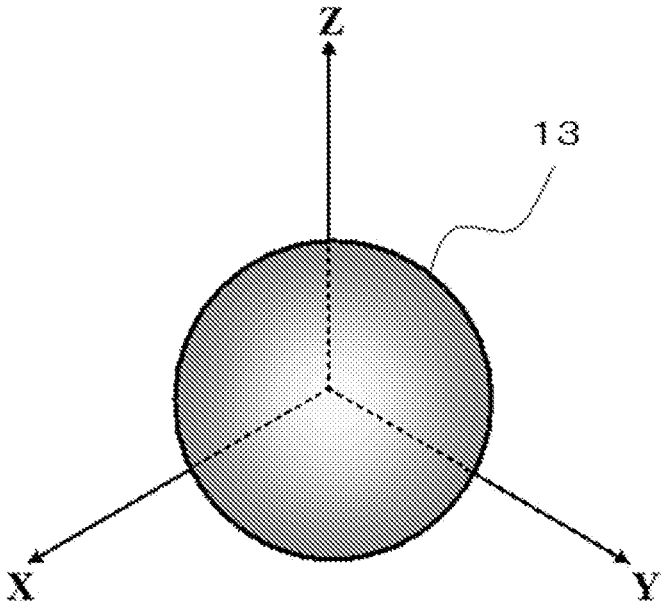
[Fig. 6B]
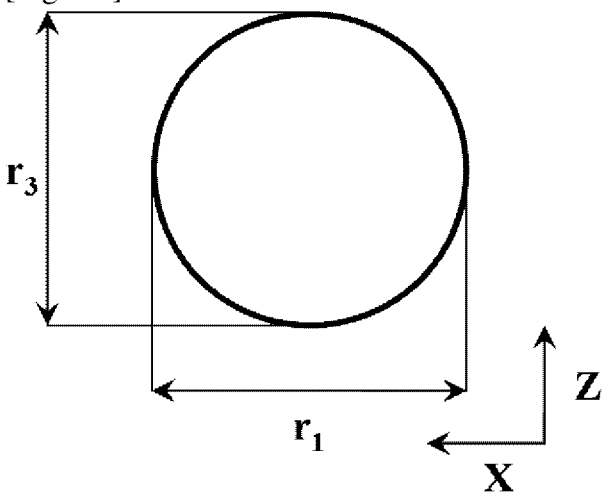
[Fig. 6C]
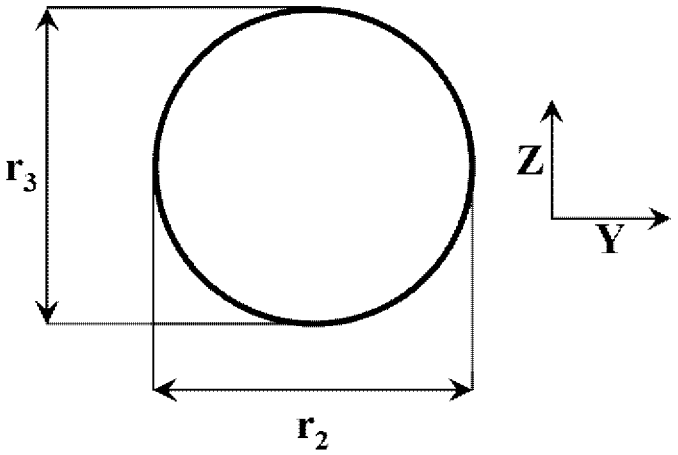

IMAGE FORMING APPARATUS AND IMAGE FORMING METHOD

TECHNICAL FIELD

The present disclosure relates to an image forming apparatus and an image forming method.

BACKGROUND ART

Recently, an intermediate transfer belt system has been used in full-color electrophotographic devices, where the intermediate transfer belt system is a system configured to superimpose four color developed images of yellow, magenta, cyan, and black on an intermediate transfer member temporarily, and then to transfer the images onto a transfer medium, such as paper, at once.

In order to impart flexibility and toner releasing ability to the intermediate transfer belt and realize a high transfer rate regardless of a transfer medium for use, proposed are various transfer belts each having a structure where a flexible rubber elastic layer is laminated on a base layer and a layer formed of particles is formed on a surface of the belt.

For example, PTL 1 discloses to over a surface of an intermediate transfer belt with beads having diameters of 3 micrometers or less. PTL 2 and PTL 3 each disclose to form a surface of an intermediate transfer belt with a layer formed of a material having affinity with hydrophobic-treated particles. PTL 4 and PTL 5 each disclose a structure where relatively large particles are embedded in a resin of a surface layer of an intermediate transfer belt. PTL 6 discloses to arrange particles obtained by treating inorganic particles, such as alumina, boron nitride, and glass, with a silane coupling agent on a surface of an intermediate transfer belt. PTL 7 and PTL 8 each discloses to arrange spherical particles including a resin, such as a silicone resin and a fluororesin, as a main component, on a surface of an intermediate transfer belt. PTL 9 discloses that particles having relatively low volume resistivity are arranged on a surface of an intermediate transfer belt.

Moreover, it is important for toners used in recent ultra high-speed printing systems to have stable transfer properties and cleaning properties in order to continuously output images of a constant image quality in severe conditions for use, such as fluctuations of the temperature and humidity at which an image forming apparatus is used and continuous output of images on the large number of sheets. To this end, numerous inventions associated with types of external additives, various physical properties, and numerical values in parts of formulation ingredients are disclosed.

For example, PTL 10 discloses a technique where separation of external additives from toner base particles or embodiment of the external additives in the toner base particles can be suppressed and a long-term stability of the toner is obtained by using the external additives produced by a sol-gel method, and specifying particle diameters of the external additives, a ratio between the minimum particle diameter and the number average primary particle diameter, and a ratio between the maximum particle diameter and the number average primary particle diameter.

CITATION LIST

Patent Literature

[PTL 1] Japanese Unexamined Patent Application Publication No. 09-230717

[PTL 2] Japanese Unexamined Patent Application Publication No. 2002-162767

[PTL 3] Japanese Unexamined Patent Application Publication No. 2004-354716

[PTL 4] Japanese Unexamined Patent Application Publication No. 2007-328165

[PTL 5] Japanese Unexamined Patent Application Publication No. 2009-75154

[PTL 6] Japanese Unexamined Patent Application Publication No. 2015-148660

[PTL 7] Japanese Patent No. 5786181

[PTL 8] Japanese Unexamined Patent Application Publication No. 2012-194223

[PTL 9] Japanese Unexamined Patent Application Publication No. 2004-053918

[PTL 10] Japanese Unexamined Patent Application Publication No. 2011-043759

SUMMARY OF INVENTION

Technical Problem

The present disclosure has an object to provide an image forming apparatus having stably excellent transfer properties over a long period on a special transfer member, such as paper having surface irregularities, having excellent half-tone transfer properties with a full-color mode, and having excellent cleaning properties.

Solution to Problem

According to one aspect of the present disclosure, an image forming apparatus includes an image bearer where a latent image is to be formed on the image bearer and the image bearer can bear a toner image, a developing unit configured to develop a latent image formed on the image bearer with a toner to form the toner image, an intermediate transfer member, on which the toner image formed through the development performed by the developing unit is primary transferred, and a transferring unit configured to secondary transfer the toner image born on the intermediate transfer member to a recording medium. The intermediate transfer member includes a laminate including a base layer and an elastic layer. The elastic layer includes particles at a surface of the elastic layer to form convex-concave shapes at the surface. The particles have volume resistivity of from $1\times10^{0}$ ohm*cm through $1\times10^{9}$ ohm*cm. The toner includes an additive. An amount of the additive separated from the toner is from 20 percent by mass through 35 percent by mass relative to a total amount of the additive in the toner, when a toner dispersion liquid in which the toner is dispersed in a dispersant is irradiated with ultrasonic wave vibration with an irradiation energy dose of 4 kJ. The toner has a dielectric constant of 2.6 or greater but 3.9 or less.

Advantageous Effects of Invention

The present disclosure can provide an image forming apparatus having stably excellent transfer properties over a long period on a special transfer member, such as paper having surface irregularities, having excellent half-tone transfer properties with a full-color mode, and having excellent cleaning properties.

BRIEF DESCRIPTION OF DRAWINGS

FIG. 1 is a schematic view illustrating one example of a layer structure of an intermediate transfer member of an image forming apparatus of the present disclosure.

FIG. 2A is an enlarged schematic view illustrating a top view of a surface of the intermediate transfer member.

FIG. 2B is a schematic view illustrating one example of a structure of a particle.

FIG. 3 is a schematic view illustrating one example of a method for applying the particles to an elastic layer.

FIG. 4 is a schematic view illustrating one example of the image forming apparatus of the present disclosure.

FIG. 5 is a main area schematic view illustrating another example of the image forming apparatus of the present disclosure.

FIG. 6A is a schematic view describing a measurement of sphericity when the particles are spheres.

FIG. 6B is a schematic view describing a measurement of sphericity when the particles are spheres.

FIG. 6C is a schematic view describing a measurement of sphericity when the particles are spheres.

DESCRIPTION OF EMBODIMENTS

The intermediate transfer members disclosed in PTL 1 to PTL 8 use insulating materials having high resistance for both particles and a coating agent. The present inventors have however found that use of an intermediate transfer member in which particles of high resistance are arranged, as disclosed in PTL 1 to PTL 8 has the following problems.

When a half-tone solid image where a half-tone image and a solid image coexist on one screen is output, it is necessary to apply high transfer electric current in order to generate a density of a solid region in which a toner input amount is large (so-called a full-color mode). In this case, high transfer electric current is also applied to a half-tone region in which a toner input amount is small. Therefore, the toner in the half-tone region is overcharged to cause reverse charge. The reverse charged toner cannot be transferred with the force of the electric field. As a result, the transfer rate significantly decreases. In the case where the intermediate transfer member disclosed in each of PTL 1 to PTL 8 is used, a transfer rate of a half-tone becomes significantly low with a full-color mode (particularly significantly appeared in black). The transfer rate is improved in PTL 9, but stability of the transfer rate cannot be maintained in severe conditions for use, such as fluctuations of the temperature and humidity at which an image forming apparatus is used and continuous output of images on the large number of sheets.

Accordingly, the present inventors diligently researched on the above-mentioned newly recognized problem associated with half-tone transfer properties. As a result, the present inventors have found that the problem can be solved by using an intermediate transfer member, in which particles having volume resistivity of from $1\times10^{0}$ ohm*cm through $1\times10^{9}$ ohm*cm are arranged on a surface of an elastic layer, a liberation ratio is from 20 percent by mass through 35 percent by mass where the liberation ratio is a ratio of an amount of the additive separated from the toner relative to a total amount of the additive added, when a toner dispersion liquid in which the toner is dispersed in a dispersant is irradiated with ultrasonic wave vibration with an irradiation energy dose of 4 kJ, and the toner having a dielectric constant of 2.6 or greater but 3.9 or less is used.

(Intermediate Transfer Member)

The intermediate transfer member for use in the image forming apparatus of the present invention is an intermediate transfer member to which a toner image is transferred, where the toner image is obtained by developing a latent image formed on the image bearer with a toner. The intermediate transfer member includes a base layer, and an elastic layer disposed on the base layer, where the elastic layer includes particles to form convex-concave shapes. A volume resistivity of the particles is from $1\times10^{0}$ ohm*cm through $1\times10^{9}$ ohm*cm. The intermediate transfer member may further include other members according to the necessity.

One example of a layer structure of the intermediate transfer member of the present disclosure will be described with reference to FIG. 1. As a specific structure, a flexible elastic layer 12 is laminated on a rigid base layer 11 that can be relatively flexible. On the outermost surface of the intermediate transfer member, particles 13 are independently aligned (embedded) in the in-plane direction on the elastic layer to form uniform convex-concave shapes. In the monodispersed state of the particles 13 of the present disclosure, the particles are not overlapped one another in a thickness direction of the layer, and the particles 13 are hardly completely embedded in the elastic layer 12.

As the intermediate transfer member, there are a belt-type intermediate transfer member and a drum-shaped intermediate transfer member. In the present disclosure, the intermediate transfer member is not particularly limited and may be appropriately selected. The intermediate transfer member is preferably an intermediate transfer belt, and more preferably, particularly an endless belt that is a so-called seamless intermediate transfer belt.

As a specific embodiment, an example of an intermediate transfer belt will be described hereinafter.

<Base Layer>

The base layer 11 in FIG. 1 will be described.

For example, the base layer includes a resin and an electric resistance adjusting agent. The base layer may further include other components according to the necessity.

—Resin—

In view of inflammability, examples of the resin include: fluorine-based resins, such as PVDF and ETFE; polyimide resins; and polyamideimide resins. Among the above-listed examples, a polyimide resin or a polyamideimide resin is preferable in view of mechanical strength (high elasticity) and heat resistance.

The polyimide resin or polyamideimide resin is not particularly limited and may be appropriately selected depending on the intended purpose. As the polyimide resin, for example, a general purpose product can be obtained from manufacturers, such as DU PONT-TORAY CO., LTD., Ube Industries, Ltd., New Japan Chemical Co., Ltd., JSR Corporation, UNITIKA LTD., iST Corporation, Hitachi Chemical Company, Ltd., TOYOBO CO., LTD., and ARAKAWA CHEMICAL INDUSTRIES, LTD.

—Electric Resistance Adjusting Agent—

The electric resistance adjusting agent is not particularly limited and may be appropriately selected depending on the intended purpose. Examples of the electric resistance adjusting agent include metal oxide, carbon black, ion conducting agents, and conductive polymer materials.

Examples of the metal oxide include zinc oxide, tin oxide, titanium oxide, zirconium oxide, aluminium oxide, and silicon oxide. Moreover, an electric resistance adjusting agent obtained by performing a surface treatment on the metal oxide in advance for the purpose of improving dispersibility is listed as an example.

Examples of the carbon black, Ketchen black, furnace black, acetylene black, thermal black, and gas black.

Examples of the ion conducting agent include tetraalkyl ammonium salts, trialkyl-benzylammonium salts, alkyl sulfonic acid salts, alkyl benzene sulfonic acid salts, alkyl sulfate, glycerin fatty acid esters, sorbitan fatty acid esters, polyoxyethylene alkylamine, polyoxyethylene fatty acid alcohol ester, alkyl betaine, and lithium per-chlorate.

The electric resistance adjusting agent may be used alone or in a combination.

As a resistance value of the intermediate transfer member, a surface resistivity thereof is preferably from $1\times10^{8}$ ohm/square through $1\times10^{13}$ ohm/square. As the resistance value of the intermediate transfer member, moreover, a volume resistivity thereof is preferably from $1\times10^{8}$ ohm*cm through $1\times10^{11}$ ohm*cm. The electric resistance adjusting agent is added in a manner that the above-mentioned resistance value is obtained. In view of mechanical strength, an amount of the electric resistance adjusting agent added is adjusted not to make a resulting film brittle and prone to crack. In the case where the intermediate transfer member is an intermediate transfer belt, moreover, it is preferable that an intermediate transfer belt having electrical properties (surface resistance and volume resistivity) and mechanical strength with good balance be produced using a coating liquid in which the amounts of the resin component (e.g., a polyimide resin precursor or polyamideimide resin precursor) and electric resistance adjusting agent are appropriately adjusted.

An amount of the electric resistance adjusting agent in the base layer is not particularly limited and may be appropriately selected depending on the intended purpose. In the case where the electric resistance adjusting agent is carbon black, the amount thereof is preferably 10 percent by mass or greater but 25 percent by mass or less, and more preferably 15 percent by mass or greater but 20 percent by mass or less relative to the base layer. In the case where the electric resistance adjusting agent is the metal oxide, the amount thereof is preferably 1 percent by mass or greater but 50 percent by mass or less, and more preferably 10 percent by mass or greater but 30 percent by mass or less relative to the base layer.

When the amount is the lower limit of the above-mentioned preferable range or higher, uniformity of a resistance value is easily obtained and variations in the resistance value against the predetermined potential become small. When the amount is the upper limit of the above-mentioned preferable range or less, the mechanical strength of the intermediate transfer belt is hardly decreased and therefore it is preferable on practical use.

—Other Components—

Examples of the above-mentioned other components include dispersion aids, reinforcing agents, lubricants, heat conduction agents, and antioxidants.

An average thickness of the base layer is not particularly limited and may be appropriately selected depending on the intended purpose. The average thickness thereof is preferably from 30 micrometers through 150 micrometers, more preferably from 40 micrometers through 120 micrometers, and particularly preferably from 50 micrometers through 80 micrometers.

When the thickness of the base layer is 30 micrometers or greater, splits of the belt from cracks can be prevented. When the thickness of the base layer is 150 micrometers or less, the belt can be prevented from being broken due to bending. Meanwhile, the thickness of the base layer being within the above-mentioned particularly preferable range is advantageous in terms of durability. In order to enhance running stability, it is preferable that unevenness of the film thickness of the base layer be avoided as much as possible.

A measuring method of the average thickness of the base layer is not particularly limited and may be appropriately selected depending on the intended purpose. Examples of the measuring method include a measuring method using a contact or eddy current film thickness gauge and a method where a cross-section of a film is measured by a scanning electron microscope (SEM).

<Elastic Layer>

The elastic layer 12 laminated on the base layer 11 in FIG. 1 will be described.

The elastic layer is not particularly limited and may be appropriately selected depending on the intended purpose, as long as the elastic layer includes particles to form convex-concave shapes. The elastic layer includes an elastic material and may further include other components according to the necessity.

The convex-concave shapes of the surface of the elastic layer can be confirmed, for example, by observing under LEXT OLS4100 available from Olympus Corporation.

—Elastic Material—

The elastic material is not particularly limited and may be appropriately selected depending on the intended purpose, as long as the elastic material is a material having sufficient flexibility (elasticity). Examples of the elastic material include resins, elastomers, and rubbers. Among the above-listed examples, elastomers and rubbers are preferable.

Examples of the elastomer include thermoplastic elastomer and thermoset elastomer.

Examples of the thermoplastic elastomer include polyester-based thermoplastic elastomer, polyamide-based thermoplastic elastomer, polyether-based thermoplastic elastomer, polyurethane-based thermoplastic elastomer, polyolefin-based thermoplastic elastomer, polystyrene-based thermoplastic elastomer, polyacryl-based thermoplastic elastomer, polydiene-based thermoplastic elastomer, silicone-modified polycarbonate-based thermoplastic elastomer, and fluorine-based copolymer.

Examples of the thermoset elastomer include polyurethane-based thermoset elastomer, silicone-modified epoxy-based thermoset elastomer, and silicone-modified acryl-based thermoset elastomer.

Examples of the rubber include isoprene rubber, styrene rubber, butadiene rubber, nitrile rubber, ethylenepropylene rubber, butyl rubber, silicone rubber, chloroprene rubber, acrylic rubber, chlorosulfonated polyethylene, fluororubber, urethane rubber, and hydrin rubber.

Among the above-listed examples, acrylic rubber is particularly preferable in view of ozone resistance, flexibility, adhesion to particles, inflammability, and stability against environments. The acrylic rubber will be described hereinafter.

The acrylic rubber is not particularly limited and may be appropriately selected depending on the intended purpose. For example, carboxyl group-crosslinked acrylic rubber is preferably selected from various (e.g., an epoxy group, an active chlorine group, and a carboxyl group) crosslinked acrylic rubber because carboxyl group-crosslinked acrylic rubber has excellent rubber physical properties (particularly, com-pression set) and processability.

A crosslinking agent used for the carboxyl group-crosslinked acrylic rubber is preferably an amine compound and more preferably a polyvalent amine compound.

Examples of the amine compound include aliphatic polyvalent amine crosslinking agent, and an aromatic polyvalent amine crosslinking agent.

Examples of the aliphatic polyvalent amine crosslinking agent include hexamethylenediamine, hexamethylenediamine carbamate, and N,N'-dicinnamylidene-1,6-hexanediamine.

Examples of the aromatic polyvalent amine crosslinking agent include 4,4'-methylenedianiline, m-phenylenediamine, 4,4'-diaminodiphenyl ether, 3,4'-diaminodiphenyl ether, 4,4'-(m-phenylenediisopropylidene)dianiline, 4,4'-(p-phenylenediisopropylidene)dianiline, 2,2'-bis[4-(4-aminophenoxy)phenyl]propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriamino.

An amount of the crosslinking agent is preferably 0.05 parts by mass or greater but 20 parts by mass or less, and more preferably 0.1 parts by mass or greater but 5 parts by mass or less relative to 100 parts by mass of the acrylic rubber.

When the amount of the crosslinking agent is 0.05 parts by mass or greater but 20 parts by mass or less, crosslinking is properly performed and physical properties of a resultant crosslinked product, such as shape retention and elasticity, are excellent.

A crosslinking accelerator may be further added to the elastic layer and may be used in combination with the crosslinking agent.

The crosslinking accelerator is not particularly limited and may be appropriately selected depending on the intended purpose. The crosslinking accelerator is preferably a crosslinking accelerator that can be used in combination with the polyvalent amine crosslinking agent. Examples of such a crosslinking accelerator include a guanidine compound, an imidazole compound, quaternary onium salt, tertiary phosphine compound, and alkali metal salt of weak acid.

Examples of the guanidine compound include 1,3-diphenylguanidine and 1,3-di-ortho-tolylguanidine.

Examples of the imidazole compound include 2-methylimidazole and 2-phenylimidazole.

Examples of the quaternary onium salt include tetra-n-butylammonium bromide and octadecyl tri-n-butylammonium bromide.

Examples of the polyvalent tertiary amine compound include triethylene diamine, 1,8-diaza-bicyclo[5.4.0]undec-7-ene (DBU).

Examples of the tertiary phosphine compound include triphenyl phosphine and tri-p-tolylphosphine.

Examples of the alkali metal salt of weak acid include inorganic weak acid salts (e.g., phosphoric acid salt or carbonic acid salt of sodium or potassium) and inorganic weak acid salts (e.g., stearic acid salt and lauric acid salt).

An amount of the crosslinking accelerator is preferably 0.1 parts by mass or greater but 20 parts by mass or less, and more preferably 0.3 parts by mass or greater but 10 parts by mass or less relative to 100 parts by mass of the acrylic rubber.

—Other Components—

The above-mentioned other components are not particularly limited and may be appropriately selected depending on the intended purpose. Examples thereof include an electric resistance adjusting agent, a flame retardant for imparting incombustibility, an antioxidant, a reinforcing agent, fillers, and a vulcanization accelerator. The above-listed examples may be used alone or in combination.

For example, an appropriate mixing method, such as roll mixing, Banbury mixing, screw mixing, and solution mixing, can be employed for the preparation of the acrylic rubber. The order for blending is not particularly limited. After sufficiently mixing components that are not easily decomposed by heat or a reaction, components that are easily reacted with heat or components that are easily decomposed, such as a cross-linking agent, may be mixed within a short period of time at a temperature at which a reaction or decomposition does not occur.

The acrylic rubber can be crosslinked by heating.

A heating temperature is preferably 130 degrees Celsius or higher but 220 degrees Celsius or lower and more preferably 140 degrees Celsius or higher but 200 degrees Celsius or lower. A crosslinking duration is preferably 30 seconds or longer but 5 hours or shorter.

A heating method may be appropriately selected from methods used for crosslinking of rubber, such as press heating, steam heating, oven heating, and hot air heating. After performing crosslinking once, moreover, post-crosslinking may be performed to make sure that an inner area of a crosslinked product is crosslinked. Although it depends on a heating method, a crosslinking temperature, or a shape thereof, the post-crosslinking is preferably performed for 1 hour or longer but 48 hours or shorter. A heating method and a heating temperature at the time of the post-crosslinking may be appropriately selected.

A micro rubber hardness value of the elastic layer at 25 degrees Celsius and 50 percent RH is preferably 30 or greater but 80 or less.

The micro rubber hardness can be measured using a commercially available micro rubber hardness tester. For example, the micro rubber hardness can be measured by means of a "micro rubber hardness tester MD-1" available from KOBUNSHI KEIKI CO., LTD.

An average thickness of the elastic layer is preferably 200 micrometers or greater but 500 micrometers or less, and more preferably 300 micrometers or greater but 400 micrometers or less. When the average thickness is 200 micrometers or greater, an image quality against a type of paper having surface irregularities is excellent. When the average thickness is 500 micrometers or less, a weight of the elastic layer is appropriate and therefore stable running performance can be obtained without causing deflection or warp.

A thickness of the elastic layer means a thickness of an elastic material of the elastic layer excluding the particles. For example, the thickness thereof is a thickness of a region of the elastic layer where no particle is present.

The average thickness is an average value when a thickness is measured at randomly selected 10 points. For example, the thickness can be measured by observing a cross-section under a scanning electron microscope (SEM, product name: VE-7800, available from KEYENCE CORPORATION).

<Particles>

The particles 13 formed on the surface of the elastic layer in FIG. 1 will be described.

A volume resistivity of the particles is from $1\times10^{0}$ ohm*cm through $1\times10^{9}$ ohm*cm, and preferably from $1\times10^{1}$ ohm*cm through $1\times10^{3}$ ohm*cm.

A constitutional material or structure of the particles is not particularly limited as long as the particles have the above-mentioned predetermined volume resistivity and may be appropriately selected depending on the intended purpose. For example, the particles may have a single-layer structure, or a core-shell two-layer structure formed by coating particles, which are bases, with a resin etc., as described below.

For example, the particles may be particles having a core-shell structure formed by coating or covering, through polymerization, surfaces of insulating particles or particles having higher resistance than the insulating particles with a conductive resin, or covering the surfaces of the particles with a metal through electroless plating. Moreover, shapes of the particles are not particularly limited as long as the particles have the above-mentioned predetermined volume resistivity and may be appropriately selected depending on the intended purpose. For example, the particles may be spherical particles, or non-spherical irregular-shaped particles. Preferably, the particles are spherical particles. Particularly, the particles are preferably true sphere particles having a high circularity as described below.

In the case where the particles have the above-described core-shell structure, shapes of base particles thereof are preferable spheres. When the base particles are spheres, shapes of the particles after coating the base particles with a resin are easily shapes into spheres.

As a size of the particles, an average particle diameter of the particles may be 100 micrometers or less. When the particles are loaded on the elastic layer, the particle diameters of the particles are not limited as long as the particles have a size with which a toner does not enter gaps between the particles. The average particle diameter of the particles is preferably 5 micrometers or less, more preferably from 0.5 micrometers through 5 micrometers, and particularly preferably from 1 micrometer through 2 micrometers.

<<Specific Embodiment of Particles>>

The particles are particularly preferably particles obtained by coating surface of particles having a high resistance with a conductive layer in view of transfer properties.

A schematic view of particles having a core-shell structure obtained by coating high resistance particles that are bases with a resin is illustrated in FIG. 2B. In FIG. 2B, the numerical reference 13A represents a base particle (high resistance particle) and the numerical reference 13B represents a coated conductive layer.

Examples of the high resistance particles include acrylic resin particles, melamine resin particles, silicone resin particles, polyamide resin particles, polyester resin particles, and polyvinyl chloride resin particles.

Examples of the conductive layer formed on surfaces of the high resistance particles include a conductive resin layer formed by coating a conductive resin (e.g., polypyrrole, polyaniline, polythiol, polythiophene, polyethylene dioxythiophene, and poly(3,4-ethylene dioxythiophene)) and a conductive layer formed by coating metal plating (e.g., copper and silver). Among the above-listed example, a conductive resin layer formed by coating a conductive resin, such as polythiophene and polypyrrole, is preferable in view of a toner release ability.

As a method for coating surfaces of the high resistant particles with the conductive resin layer, the surfaces of the particles may be coated by spray coating or a method known in the art may be used. Examples of the method known in the art include methods disclosed in Japanese Unexamined Patent Application Publication Nos. 2007-254558 and 2002-356654.

As the conductive resin, a commercially available product may be used. For example, polythiophene can be available from Nagase ChemteX Corporation, Heraeus K. K., or Rigaku Corporation.

Polyaniline, polyethylene dioxythiophene, and poly(3,4-ethylenedioxythiophene) can be available from KAKEN SANGYOU CORPORATION or SANKYO KASEI SANGYO CO., Ltd.

The volume resistivity of the particles can be appropriately adjusted by varying a thickness of a coating layer of a material having low resistance, such as the conductive resin. For example, the volume resistivity thereof can be adjusted to high by reducing a thickness of the coating layer, or the volume resistivity thereof can be adjusted to low by increasing the thickness of the coating layer. In the case where a material having excessively high conductivity, such as a metal, is used, attentions should be paid not to make the volume resistivity of the particles excessively low from the lower limit of the above-mentioned range.

<<Volume Resistivity of Particles>>

The volume resistivity of the particles is from $1\times10^0$ ohm*cm through $1\times10^9$ ohm*cm, and preferably from $1\times10^1$ ohm*cm through $1\times10^3$ ohm*cm.

As described above, the intermediate transfer member disclosed in each of PTL 1 to PTL 8 uses insulating materials having high resistance for both particles and a coating agent. The present inventors have found a problem that half-tone transfer properties are degraded with a full-color mode when an intermediate transfer belt to which highly resistant particles are disposed, as described in PTL 1 to PTL 8, is used.

PTL 8 discloses, as resistivity of the entire intermediate transfer belt, surface resistivity of a base layer and an elastic layer is set to from $1\times10^8$ ohm/square through $1\times10^{13}$ ohm/square, and volume resistivity is set to from $1\times10^7$ ohm*cm through $1\times10^{12}$ ohm*cm.

However, the present inventors carried out an experiment where the particles were replaced with particles having volume resistivity of a low resistance region, i.e., $1\times10^9$ ohm*cm, which is totally different from the order of resistivity known as resistivity of the entire intermediate transfer belt.

As a result, the present inventors have found (1) resistivity of the entire intermediate transfer belt does not change even when the particles are changed from the particles having high volume resistivity to the particles having low volume resistivity, and (2) the problem associated with the half-tone transfer properties with a full-color mode can be solved by setting the volume resistivity of the particles to the range of from $1\times10^0$ ohm*cm through $1\times10^9$ ohm*cm.

A reason why half-tone transfer properties with a full-color mode (high transfer electric current) are improved by setting the volume resistivity of the particles to the range of from $1\times10^0$ ohm*cm through $1\times10^9$ ohm*cm is not clear. It is assumed that, when resistance of the particles present on a surface of the intermediate transfer belt is high, it is difficult to transmit electric current through the intermediate transfer belt to cause discharge, and charge of the toner affected by discharge itself may be lowered. When resistance of the particles present on the surface of the intermediate transfer belt is too low, on the other hand, too much electric current flows the surface of the belt to inhibit discharge between the intermediate transfer belt and the image bearer (photoconductor) or between the intermediate transfer belt and paper, and therefore formation of electric field for transferring the toner may be inhibited. Accordingly, it is assumed that excellent transfer properties with maintaining a desired balance of dis-charging and formation of an electric field can be obtained when the volume resistivity of the particles present on the surface of the intermediate transfer belt is in the range of from $1\times10^0$ ohm*cm through $1\times10^9$ ohm*cm. Moreover, the present inventors have found that excellent transfer properties can be stably maintained when a liberation ratio of additive of the toner is from 20 percent by mass through 35 percent by mass and a dielectric constant of the toner is 2.6 or greater but 3.9 or less. The liberation ratio is a ratio of the additive separated from the toner when the toner used in the experiment is dispersed in a dispersant to form a toner dispersion liquid and the toner dispersion liquid is irradiated with ultrasonic wave vibration with an irradiation energy dose of 4 kJ relative to a total amount of the additive added to the toner. It is assumed that deteri-orations of the belt by the free additive particles can be prevented by setting the liberation ratio of the additive of the toner to the range of from 20 percent by mass through 35 percent by mass, and variations in transfer properties due to the toner can be suppressed by setting the dielectric constant of the toner to 2.6 or greater but 3.9 or less.

<<Measurement Method of Volume Resistivity of Particles>>

The volume resistivity of the particles can be measured, for example, by MCP-PD51 or LORESTA GP (HIRESTA UP, if resistance is high) available from Mitsubishi Chemical Analytech Co., Ltd.

A measurement method is as follows. A pressure container having a diameter of 15 mm is charged with 1 g of the particles in an environment of 23 degrees Celsius and 50 percent RH and load of 4 KN is applied. Thereafter, a value obtained by measuring at 20 KV is read.

<<Existing State of Particles>>

FIG. 2A is an enlarged schematic view where a surface of the intermediate transfer member is observed from top. As illustrated, the particles having the uniform particle diameter are independently aligned orderly. Overlapping of the particles one another is hardly observed. It is preferable that diameters of cross-sections of the particles, which constitute the surface, cut along the surface of the elastic layer be uniform. Specifically, a distribution width of the diameter is preferably plus/minus (average particle diameter×0.5) micrometers or less.

In order to form the surface having such a distribution width of the diameter of the particles, it is preferable that particles having particle diameters as similar as possible be used. Even when such particles are not use, a surface may be formed by a method where particles of certain particle diameters are selectively aligned on the surface to achieve the above-mentioned distribution width of the particle diameters.

An occupation area ratio of the particles on the surface of the elastic layer is preferably 60 percent or greater. When the occupation area ratio is 60 percent or greater, exposure of the resin part is appropriate and excellent transfer properties can be obtained.

The particles are partially embedded in the elastic layer. The embedding ratio of the particles is preferably greater than 50 percent but less than 100 percent, and more preferably from 51 percent through 90 percent. When the embedding ratio is greater than 50 percent, the particles are rarely separated from the intermediate transfer member after use of a long period in an image forming apparatus and excellent durability is obtained. When the embedding ratio is less than 100 percent, an effect of the spherical particles to the transfer properties rarely reduces and therefore such the embedding ratio is preferable.

The embedding ratio is a ratio of the diameter of the particle embedded in the elastic layer in the depth direction. In the present specification, the embedding ratio does not mean that the embedding ratio of all of the particles is greater than 50 percent but less than 100 percent, but the embedding ratio may mean that a numerical value of an average embedding ratio of the particles observed from a certain field of view is greater than 50 percent but less than 100 percent. When the embedding ratio is 50 percent, however, the particles completely embedded in the elastic layer are hardly observed (percent by number of the particles completely embedded in the elastic layer is 5 percent or less relative to a total of the spherical particles) in the observation of the cross-section under an electron microscope.

<<Sphericity of Particles>>

As described above, shapes of the particles of the present disclosure are preferably spheres and more preferably true spheres having the higher sphericity. In the present disclosure, the sphericity is determined as follows.

The particles of the present disclosures are homogeneously dispersed and deposited on a smooth measurement surface. By means of a color laser microscope (device name: VK-8500, available from KEYENCE CORPORATION), measurements of a long axis $r_1$ (micrometers), a short axis $r_2$ (micrometers), and a thickness $r_3$ (micrometers) are performed on 100 particles with enlarging with a predetermined magnification (e.g., 1,000 times), as illustrated in FIGS. 6A to 6C. Then, the arithmetic mean value of the measured values is determined. In this manner, the sphericity of the particles can be measured.

In the present disclosure, the particles having a ratio ($r_2/r_1$) between the long axis and the short axis being 0.9 or greater but 1.0 or less and a ratio ($r_3/r_2$) between the thickness and the short axis being 0.9 or greater but 1.0 or less are regarded as true spheres.

<Production Method of Intermediate Transfer Belt>

One example of a method for producing the intermediate transfer belt for use in the present invention will be described. First, a production method of a base layer will be described.

A method for producing a base layer using a base layer coating liquid including at least a resin component, i.e., a base layer coating liquid including the polyimide resin precursor or polyamideimide resin precursor will be described.

While slowly rotating a cylindrical mold, e.g., a cylindrical metal mold, a coating liquid including at least a resin component (e.g., a coating liquid including a polyimide resin precursor or polyamideimide resin precursor) is uniformly applied and flow casted (formation of a coating film) onto the entire outer circumferential surface of the cylinder by a liquid supplying device, such as a nozzle and a dispenser. Thereafter, the rotational speed is increased to the predetermined speed. Once the rotational speed reaches the predetermined speed, the rotational speed is maintained at the constant speed, and the rotation is continued for the desired duration. While rotating and gradually heating, the solvent in the coating film is evaporated at a temperature of 80 degrees Celsius or higher but 150 degrees Celsius or lower. During the removal of the solvent, it is preferable that vapor (evaporated solvent etc.) in the atmosphere be efficiently circulated and removed. When a self-supporting film is formed, the film together with the mold is transferred to a heating furnace (firing furnace) capable of performing a high temperature treatment, a temperature is increased stepwise, and eventually a high temperature heating treatment (firing) of 250 degrees Celsius or higher but 450 degrees Celsius or lower is performed, to sufficiently perform imidization of the polyimide resin precursor or polyamideimidization of the polyamideimide resin precursor. After sufficiently cooling the resultant, an elastic layer is sequentially laminated.

The elastic layer can be produced by applying a rubber coating material, which is prepared by dissolving rubber in an organic solvent, onto the base layer, drying the solvent, and vulcanizing. As a coating method of the rubber coating material, similarly to the formation of the base layer, known coating methods, such as spiral coating, die coating, and roll coating, can be used. In order to improve transfer properties of convex-concave shapes, a thickness of the elastic layer needs to be thick. As a coating method for forming a thick film, die coating and spiral coating are excellent. Spiral coating is excellent because a thickness of the elastic layer is easily changed along a width direction as described above. In the present specification, therefore, spiral coating will be described. While rotating the base layer in the circumferential direction, the rubber coating material is continuously supplied by a circular or wide width nozzle with moving the nozzle along the axial direction of the base layer to spirally apply the coating material onto the base layer. The coating material spirally applied onto the base layer is dried with being levelled by maintaining the predetermined rotational speed and drying temperature. Thereafter, the dried coating material is vulcanized (cross-linked) at the predetermined vulcanizing temperature to form an elastic layer. In order to change a film thickness along a width direction, an ejecting amount of the nozzle or a distance between the nozzle and the mold is changed, or the rotational speed of the mold is changed.

Next, the vulcanized elastic layer is then sufficiently cooled. Subsequently, the particles are applied onto the elastic layer to form a particle layer to thereby obtain a desired intermediate transfer belt (seamless belt).

As a method for forming the particle layer, as illustrated in FIG. 3, a powder supply device 35 and a press member 33 are disposed, the particles 34 are uniformly scattered onto a surface of the elastic layer 32 from the powder supply device 35 with rotating a mold drum 31, and the particles scattered on the surface are pressed by the press member 33 at certain pressure.

While embedding the particles in the elastic layer with the press member 33, excess particles are removed. In the present disclosure, a uniform monodisperse particle layer can be formed only by a simple step including only the above-described leveling process with the press member, particularly because monodisperse particles are used. The adjustment of the embedding rate can be performed with duration for pressing with the press member.

The adjustment of the embedding rate of the particles in the elastic layer is not particularly limited and may be appropriately selected depending on the intended purpose. For example, the embedding rate can be easily adjusted by increasing or decreasing pressing force of the press member. Although it depends on viscosity and solid content of a flow casting coating liquid, an amount of a solvent used, and a material of the particles, the embedding rate of 50 percent or greater but 100 percent or less can be relatively easily achieved by adjusting, as a guidance, the pressing pressure to the range of 1 mN/cm or greater but 1,000 mN/cm or less with the viscosity of the flow casting coating liquid being 100 mPa*s or greater but 100,000 mPa*s or less. After uniformly aligning the particles on the surface, the resultant is heated for the predetermined duration at the predetermined temperature with rotating to thereby cure and form an elastic layer in which the particles are embedded. After sufficiently cooling, the resultant is released from the mold from the side of the base layer to thereby obtain the desired intermediate transfer belt (seamless belt).

A method for measuring the embedding rate of the particles in the intermediate transfer belt is not particularly limited and may be appropriately selected depending on the intended purpose. For example, the embedding rate can be measured by observing a cross-section of the intermediate transfer member by a scanning electron microscope (SEM) or a laser microscope.

Resistance of the intermediate transfer belt produced in the above-described manner can be adjusted by varying an amount of carbon black or ion conducting agent. At the time of the adjustment, attentions should be paid because resistance easily changes depending on a size of the particles or an occupation area ratio of the particles.

As the resistance value of the intermediate transfer belt, surface resistivity is preferably $1\times10^{8}$ ohm/square or greater but $1\times10^{13}$ ohm/square or less and volume resistivity is preferably $1\times10^{8}$ ohm*cm or greater but $1\times10^{11}$ ohm*cm or less.

For example, resistance of the intermediate transfer belt can be adjusted by varying an amount of carbon black or an ion conducting agent. At the time of the adjustment, attentions should be paid because resistance easily changes depending on a size of the particles or an occupation area ratio of the particles.

For a measurement of the resistance, a commercially available measuring instrument can be used. For example, the measurement can be performed by means of HIRESTA available from Mitsubishi Chemical Analytech Co., Ltd.

Note that, the measured values of the resistance of the belt itself does not change even when either the particles having high volume resistivity or the particles having low volume resistivity are used on the surface of the elastic layer probably because a size of the particles themselves is small.

(Toner)

In the image forming field of the current electrophotography system, a toner ap-plicable for a high-speed printing system has a task to achieve both low deposition force and low-temperature fixing ability in order to continuously output images of constant image quality even when the toner is used under severe conditions, such as fluctuations of the temperature and humidity at which an image forming apparatus is used and continuous output of images on the large number of sheets.

The above-described task is achieved by adding particles, such as silica, to the toner. However, a state where additive particles are deposited on surfaces of toner particles also significantly affects process compatibility. For example, an additive having weak deposition force with a toner particle or undeposited additive tend to move and deposit onto a transfer member, leading to filming etc., which is a cause for lowering a transfer rate. When the deposition force of the additive to a toner particle is too strong, on the other hand, the additive particles are embedded in the toner particle, and the additive does not function as spacers between the toner particles, leading to problems, such as blocking and low transfer properties. When an amount of the additive is further increased in order to obtain desired toner properties, an amount of the additive having weak deposition force increases as the covering ratio of the toner reaches a certain point or higher because there are a limit in a surface area of toner base particles. Therefore, a ratio of the additive transferred and deposited onto the transfer member increases, and image defects due to partially low transfer properties may occur.

As a unit for controlling the deposition state of the additive as in the present disclosure, preferable is a unit that is equipped with a jacket etc. for preventing an increase in a temperature of the toner as a result of the application of energy from the mixing and is capable of controlling a temperature inside the unit. Mixing upon application of high energy and homogeneous mixing may be performed by optionally disposing a various shapes of deflectors (partition plate) inside a mixer to adjust energy applied to the toner particles and external additive. In order to change a history of load applied to the additive, a method where the additive is added in the middle of the process or as needed may be applied. Moreover, the rotational speed, rolling speed, duration, temperature etc. of the mixer may be changed. Initially, large load is applied and relatively weak load may be applied next, or vice-versa. Examples of usable mixing equipment include Rocking Mixer, Loedige Mixer, Nauta Mixer, and Henschel Mixer.

<Liberation Ratio of Additive>

The additive separated from the toner are measured in the following manner.

(1) A toner sample (3.75 g) is dispersed in 50 mL of a 0.5 percent by mass poly-oxyalkylene alkyl ether (NOIGEN ET-165, DKS Co., Ltd.) dispersion liquid in a 110 mL vial.

(2) The resultant dispersion liquid is irradiated with ultrasonic waves for 100 seconds at frequency of 20 kHz and output of 40 W (40 Wx100 seconds=4 kJ) by means of a ultrasonic wave homogenizer (product name: homogenizer, type: VCX750, CV33, available from SONICS & MATERIALS). During the irradiation, the treatment is performed in a manner that the liquid temperature of the toner dispersion liquid was not to be 40 degrees Celsius or higher.

(3) The obtained dispersion liquid is subjected vacuum filtration with filter paper (product name: qualitative filter paper (No. 2, 110 mm), available from Advantec Toyo Kaisha, Ltd.). The resultant is again washed with ion-exchanged water twice, followed by filtration. After removing the separated additive in the manner as mentioned, the toner is dried.

(4) An amount of the additive of the toner before and after removing the additive is quantified by calculating a percentage by mass from a strength (or a difference in intensity before and after the removal of the external additive) of a calibration curve by a fluorescent X-ray spectrometer (ZSX-100e, available from Rigaku Corporation), to thereby determine a liberation amount of the additive.

Liberation amount=(mass of additive before dispersion)−(mass of remained additive after dispersion) <<Mathematical formula 1>>

The liberation ratio (percent by mass) of the additive can be determined by the following mathematical formula 2.

Liberation ratio=[liberation amount/total added amount of additive]×100 <<Mathematical formula 2>>

The total added amount of the additive is determined as follows.

By means of the ultrasonic homogenizer, the toner is irradiated with ultrasonic waves in the irradiation energy dose of 1,000 kJ and 1,500 kJ in the same manner as described above to confirm there is no reduction in the amount of the additive between the irradiation of 1,000 kJ and the irradiation of 1,500 kJ. In a case where there is no reduction, it can be judged that all of the additive is separated from the toner.

Moreover, surfaces of the particles of the toner after the treatment may be observed under a field emission scanning electron microscope (FE-SEM) to confirm that all of the additive is separated. When there is a change, the same treatment is performed with increasing the irradiation energy dose by 500 kJ.

The total added amount of the additive is calculated from a difference between the amount of the additive of the toner from which all of the additive is separated as described above and an amount of the additive of the non-treated toner.

After separating all of the additive as described above, an "amount of the additive of the toner from which all of the additive is separated" is measured by X-ray fluorescence spectroscopy. As a result, the amount of the additive is zero, or in the case where a material identical to the material of the additive is included in the base particles, the amount of the additive becomes a constant value influenced by the identical material included in the base particles. When an amount of the additive of the untreated toner is measured by X-ray fluorescence spectroscopy, on the other hand, the amount of the additive is detected, or in the case where a material identical to the material of the additive is included in the base particles similarly to the above, the amount of the identical material included in the base particles is added to the amount of the additive. In order to calculate the "total added amount of the additive" as an external additive, a method where a total added amount of the additive is calculated from a difference between the amount of the additive of the toner from which all of the additive are separated and the amount of the additive of the untreated toner is used.

As the liberation ratio of the additive of the toner, the liberation ratio is preferably from 20 percent by mass through 35 percent by mass when the irradiation energy dose is 4 kJ. When the liberation ratio is less than 20 percent by mass with the irradiation energy dose of 4 kJ, cleaning efficiency decreases. When the liberation ratio is greater than 35 percent by mass with the irradiation energy dose of 4 kJ, free additive particles are deposited on a transfer member and image defects occur. An amount of the additive which has weak deposition force and is likely to separate from the toner within the image forming apparatus can be measured by setting the irradiate energy to 4 kJ.

Examples of the additive include external additives.

As the additive, one kind of particles may be used, or two or more kinds of particles may be used in combination.

<Toner Dielectric Constant>

The toner is formed into a circular pellet having a diameter of 40 mm by pressure of 6 MPa using a molding machine in a manner that a thickness of the pellet is to be 2.0 mm plus/minus 0.1 mm. A measurement cell having an inner diameter of about 2 cm is tightly filled with the obtained pellet. The measurement cell is a nonconductor cylinder of TR-10C dielectric loss measuring instrument (available from Ando Electric Co., Ltd.), where metal electrodes having excellent conduction are disposed at the top and bottom of the cylinder respectively. A dielectric constant is determined according to an alternating current bridge method at 25 degrees Celsius in the indoor atmosphere with a measuring frequency of 1 KHz.

The dielectric constant of the toner is preferably from 2.6 through 3.9 and more preferably from 2.6 through 3.6.

When the dielectric constant is greater than 3.9, satisfactory transfer properties or images of a high image quality without dust particles may not be obtained. When the dielectric constant is lower than 2.6, transfer efficiency may significantly decrease in a transfer system using an electrostatic method.

Moreover, a shape or size of the toner is not particularly limited and may be appropriately selected depending on the intended purpose. The toner preferably has the following average circularity, volume average particle diameter, and ratio of the volume average particle diameter to a number average particle diameter (volume average particle diameter/number average particle diameter).

<Average Circularity of Toner>

The average circularity of the toner is a value obtained by dividing the perimeter of an equivalent circle having the identical projection area to that of a shape of the toner with a perimeter of an actual particle. For example, the average circularity of the toner is preferably from 0.925 through 0.970 and more preferably from 0.960 through 0.970. Note that, the toner is preferably toner including particles having the average circularity of less than 0.925 in an amount of 15 percent or less.

When the average circularity is 0.925 or greater, satisfactory transfer properties and images of a high image quality are easily obtained. When the average circularity is 0.970 or less, the following problems can be prevented.

(Problems)

In an image forming system employing blade cleaning etc., cleaning failures occur on a photoconductor or a transfer belt, smearing may occur on an image. For example, in case of image formation of a high imaging area rate, such as a photographic image, the toner forming an untransferred image due to a paper feeding failure etc. remains on the photoconductor as a transfer residual toner and the accumulated toner may cause background deposition of an image. Alternatively, the toner may contaminate a charging roller configured to contact charge the photoconductor, and the charging roller may not be able to exhibit the original charging capability.

An average circularity is determined by performing a measurement by means of a flow particle image analyzer (FPIA-2100, available from SYSMEX CORPORATION) and analyzing using analysis software (FPIA-2100 Data Processing Program for FPIA version00-10). Specifically, the measurement is performed in the following manner. A 100 mL-glass beaker is charged with from 0.1 mL through 0.5 mL of 10 percent by mass surfactant (alkyl benzene sulfonate, NEOGEN SC-A, manufactured by DAI-ICHI KOGYO SEIYAKU CO., LTD.) and from 0.1 g through 0.5 g of each toner. Then, the mixture is stirred by a micro-spatula, followed by adding 80 mL of ion-exchanged water. The obtained dispersion liquid is subjected to a dispersion treatment for 3 minutes by means of an ultrasonic wave disperser (available from HONDA ELECTRONICS CO., LTD.). The dispersion liquid is subjected to measurements of shapes and distribution of particles of the toner by means of FPIA-2100 until a concentration of from 5,000 particles/microliter through 15,000 particles/microliter is obtained.

It is important in the measurement method mentioned above that a concentration of the dispersion liquid is in the range of from 5,000 particles/microliter through 15,000 particles/microliter in view of the measurement reproducibility of the average circularity. In order to obtain the concentration of the dispersion liquid, conditions of the dispersion liquid, i.e., an amount of a surfactant added and an amount of a toner added, are changed. Similarly to the measurement of the toner particle diameter mentioned above, the necessary amount of the surfactant varies depending on the hydrophobicity of the toner. When a large amount of the surfactant is added, noises occur due to bubbles. When the amount of the surfactant is small, the toner cannot be sufficiently wet, and therefore dispersibility is insufficient. Moreover, the amount of the toner added varies depending on a particle diameter of the toner. When the toner has a small particle diameter, a small amount of the toner is added. When the toner has a large particle diameter, a large amount of the toner is added. In the case where the toner particle diameter is from 3 micrometers through 10 micrometers, the concentration of the dispersion liquid can be adjusted to from 5,000 particles/microliter through 15,000 particles/microliter by adding from 0.1 g through 0.5 g of the toner.

A volume average particle diameter of the toner is not particularly limited and may be appropriately selected depending on the intended purpose. For example, the volume average particle diameter thereof is preferably from 3 micrometers through 10 micrometers, more preferably from 3 micrometers through 7 micrometers, and particularly preferably from 4 micrometers through 7 micrometers. When the volume average particle diameter is 3 micrometers or greater, in case of a two-component developer, the toner is rarely fused on a surface of a carrier due to stirring performed over a long period in a developing device and a charging ability of the carrier hardly reduces. When the average particle diameter is 10 micrometers or less, an image of a high image quality is easily obtained with high resolution, and variations in particle diameters of the toner are small when the toner in the developer is consumed and then the developer is supplemented with a fresh toner.

A ratio between the volume average particle diameter and number average particle diameter of the toner (volume average particle diameter/number average particle diameter) is preferably from 1.00 through 1.25 and more preferably from 1.00 through 1.15.

The volume average particle diameter and the ratio between the volume average particle diameter and number average particle diameter (volume average particle diameter/number average particle diameter) can be determined by measuring by means of a particle size analyzer (Multisizer III, manufactured by Beckman Coulter Inc.) with an aperture diameter of 100 micrometers, and analyzing with an analysis software (Beckman Coulter Multisizer 3 Version 3.51).

A specific example of the measurement is as follows. A 10 percent by mass surfactant (alkyl benzene sulfonate, NEOGEN SC-A, available from DAI-ICHI KOGYO SEIYAKU CO., LTD.) (0.5 mL) is added to a 100 mL-glass beaker, and the toner (0.5 g) was added to the beaker. Then, the mixture is stirred by a micro-spatula, followed by adding 80 mL of ion-exchanged water. The obtained dispersion liquid is subjected to a dispersion treatment for 10 minutes by means of an ultrasonic wave disperser (W-113MK-II, available from HONDA ELECTRONICS CO., LTD.). The dispersion liquid is measured by the Multisizer III using ISOTON III (product of Beckman Coulter, Inc.) as a measurement solution.

During the measurement, the toner sample dispersing liquid is added dropwise to adjust a concentration indicated by the device to be 8 percent plus/minus 2 percent. In the measuring method as mentioned, it is important to adjust the concentration to 8 percent plus/minus 2 percent in terms of measurement repeatability of the particle diameter. There is no accidental error so long as the concentration of the toner falls within the aforementioned range.

For example, the toner includes at least a binder resin, and may further include other components according to the necessity.

Examples of the binder resin include crystalline resins and amorphous resins.

Examples of the binder resin include a polyester resin.

Examples of the polyester resin include a crystalline polyester resin and an amorphous polyester resin.

Moreover, the polyester resin may include a urethane bond and/or a urea bond.

<Amorphous Polyester Resin>

The amorphous polyester resin is preferably an unmodified polyester resin. The unmodified polyester resin is a polyester resin obtained using a polyvalent alcohol and polyvalent carbonic acid or derivative thereof, such as polyvalent carboxylic acid, polyvalent carboxylic acid anhydride, and polyvalent carboxylic acid ester, and is a polyester resin that is not modified with polyisocyanate etc.

Examples of the polyvalent alcohol include diol.

Examples of the diol include: alkylene (the number of carbon atoms: from 2 through 3) oxide (the average number of moles added: from 1 through 10) adducts of bisphenol A, such as polyoxypropylene(2.2)-2,2-bis(4-hydroxyphenyl) propane, and poly-oxyethylene(2.2)-2,2-bis(4-hydroxyphenyl)propane; ethylene glycol; propylene glycol; hydrogenated bisphenol A; and alkylene (the number of carbon atoms: from 2 through 3) oxide (the average number of moles added: from 1 through 10) adducts of hydrogenated bisphenol A.

The above-listed examples may be used alone or in combination.

Examples of the polyvalent carboxylic acid include dicarboxylic acid.

Examples of the dicarboxylic acid include adipic acid, phthalic acid, isophthalic acid, terephthalic acid, fumaric acid, maleic acid, and succinic acid substituted with an alkyl group having from 1 through 20 carbon atoms or an alkenyl group having from 2 through 20 carbon atoms (e.g., dodecenyl succinic acid and octyl succinic acid).

The above-listed examples may be used alone or in combination.

Moreover, the amorphous polyester resin may include at least one of trivalent or higher carboxylic acid and trivalent or higher alcohol.

Examples of the trivalent or higher carboxylic acid include trimellitic acid, py-romellitic acid, and anhydrides thereof.

Examples of the trivalent or higher alcohol include glycerin, pentaerythritol, and trimethylolpropane.

<Polyester Resin Having Urethane Bond and/or Urea Bond>

The polyester resin having a urethane bond and/or urea bond is not particularly limited and may be appropriately selected depending on the intended purpose. Examples thereof include a reaction product between a polyester resin having an active hydrogen group and polyisocyanate. The reaction product is preferably used as a reaction precursor (may be referred to as a "prepolymer" hereinafter) to be reacted with a below-mentioned curing agent.

Examples of the polyester resin having an active hydrogen group include a polyester resin having a hydroxyl group.

—Polyester Resin Having Active Hydrogen Group—

The polyester resin having an active hydrogen group is obtained, for example, through polycondensation of diol, dicarboxylic acid, and at least one of trivalent or higher alcohol and trivalent or higher carboxylic acid. The trivalent or higher alcohol and the trivalent or higher carboxylic acid imparts a branched structure to the polyester resin having an active hydrogen group.

Specific examples of each of the diol, the dicarboxylic acid, the trivalent or high alcohol, and the trivalent or higher carboxylic acid include the above-mentioned specific examples of each of the diol, the dicarboxylic acid, the trivalent or higher alcohol, and the trivalent or higher carboxylic acid.

—Polyisocyanate—

The polyisocyanate is not particularly limited and may be appropriately selected depending on the intended purpose. Examples of the polyisocyanate include diisocyanate and trivalent or higher isocyanate.

Examples of the diisocyanate include aliphatic diisocyanate, alicyclic diisocyanate, aromatic diisocyanate, aromatic aliphatic diisocyanate, isocyanurates, and a product obtained by any of the above-listed compound is blocked with a phenol derivative, oxime, or caprolactam.

Examples of the aliphatic diisocyanate include tetramethylene diisocyanate, hexam-ethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate, and tetramethylhexane diisocyanate.

Examples of the alicyclic diisocyanate include isophorone diisocyanate and cyclo-hexylmethane diisocyanate.

Examples of the aromatic diisocyanate include tolylene diisocyanate, diisocyana-todiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

Examples of the aromatic aliphatic diisocyanate include alpha, alpha, alpha', alpha'-tetramethylxylylene diisocyanate.

Examples of the isocyanurates include tris(isocyanatoalkyl)isocyanurate and tris(isocyanatocycloalkyl)isocyanurate.

The above-listed polyisocyanates may be used alone or in combination.

—Curing Agent—

The curing agent is not particularly limited as long as the curing agent reacts with a prepolymer and may be appropriately selected depending on the intended purpose. Examples of the curing agent include an active hydrogen group-containing compound.

——Active Hydrogen Group-Containing Compound——

An active hydrogen group in the active hydrogen group-containing compound is not particularly limited and may be appropriately selected depending on the intended purpose. Examples of the active hydrogen group include a hydroxyl group (e.g., an alcoholic hydroxyl group and a phenolic hydroxyl group), an amino group, a carboxyl group, and a mercapto group. The above-listed examples may be used alone or in combination.

The active hydrogen group-containing compound is preferably amines because a urea bond can be formed.

Examples of the amines include diamine, trivalent or higher amine, amino alcohol, amino mercaptan, amino acid, and blocked products obtained by blocking amino groups of the above-listed amines. The above-listed examples may be used alone or in combination.

Among the above-listed examples, diamine or a mixture of diamine and a small amount of trivalent or higher amine is preferable.

Examples of the diamine include aromatic diamine, alicyclic diamine, and aliphatic di amine. Examples of the aromatic diamine include phenylene diamine, diethyltoluene diamine, and 4,4'-diaminodiphenylmethane. Examples of the alicyclic diamine include 4,4'-diamino-3,3'-dimethyldicyclohexylmethane, diaminocyclohexane, and isophorone-diamine. Examples of the aliphatic diamine include ethylenediamine, tetramethylenediamine, and hexamethylenediamine.

Examples of the trivalent or higher amine include diethylenetriamine and tri-ethylenetetramine.

Examples of the amino alcohol include ethanolamine and hydroxyethylaniline.

Examples of the aminomercaptan include aminoethylmercaptan and aminopropy-lmercaptan.

Examples of the amino acid include aminopropionic acid and aminocaproic acid.

Examples of the blocked products where amino groups of the amines are blocked include a ketimine compound obtained by blocking an amino group with ketones, such as acetone, methyl ethyl ketone, and methyl isobutyl ketone, and an oxazoline compound.

A molecular structure of the amorphous polyester resin component can be confirmed by X-ray diffraction spectroscopy, GC/MS, LC/MS, and IR spectroscopy as well as liquid or solid NMR. Examples of a simple method thereof include method where a resin that does not have absorption based on delta CH (out plane bending) of olefin at 965 $cm^{-1}$ plus/minus 10 $cm^{-1}$ or 990 $cm^{-1}$ plus/minus 10 $cm^{-1}$ in the infrared absorption spectrum is detected as an amorphous polyester resin.

<Crystalline Polyester Resin>

The crystalline resin will be described with taking a crystalline polyester resin (described as a crystalline polyester resin hereinafter) as an example. Since the crystalline polyester resin has high crystallinity, the crystalline polyester resin exhibits thermal fusion properties where a viscosity thereof significantly reduces at around a fixing onset temperature. Since the crystalline polyester resin having the above-described properties is used together with an amorphous polyester resin, excellent heat resistant storage stability owing to crystallinity can be obtained up to a temperature just below a melt onset temperature and at the melt onset temperature, a significant viscosity reduction (sharp melt) can be caused by fusion of the crystalline polyester resin. Along the fusion of the crystalline polyester resin, the crystalline polyester resin becomes compatible with the amorphous polyester resin and the viscosity of both the crystalline polyester resin and the amorphous polyester resin significantly reduces to fix a toner. Therefore, the toner having excellent heat resistant storage stability and low temperature fixing ability can be obtained. Moreover, an excellent result is also obtained in a release width (a difference between the minimum fixing temperature and the hot offset onset temperature).

The crystalline polyester resin is obtained from polyvalent alcohol and polyvalent carboxylic acid or a derivative thereof, such as polyvalent carboxylic acid, polyvalent carboxylic acid anhydride, and polyvalent carboxylic acid ester.

Note that, in the present invention, the crystalline polyester resin means a polyester resin obtained from polyvalent alcohol and polyvalent carboxylic acid or a derivative thereof, such as polyvalent carboxylic acid, polyvalent carboxylic acid anhydride, and polyvalent carboxylic acid ester, as described above, and a modified polyester resin, such as the prepolymer and a resin obtained through a crosslinking and/or elongation reaction of the prepolymer, does not belong to the crystalline polyester resin.

In the present disclosure, the presence or absence of crystallinity of the crystalline polyester resin can be confirmed by a crystal analysis X-ray diffraction system (e.g., X'Pert Pro MRD, available from Malvern Panalytical Ltd.). A measuring method will be described below.

First, a target sample is ground by a motor to prepare sample powder. The obtained sample powder is uniformly applied to a sample holder. Thereafter, the sample holder is set in the diffraction system and a measurement is performed to obtain a diffraction spectrum. When a half value width of a peak whose intensity is the strongest among diffraction peaks obtained in the range of 20 degrees<2 theta<25 degrees is 2.0 or less, the sample is determined to have crystallinity.

In comparison with the crystalline polyester resin, a polyester resin that does not exhibit the above-mentioned state is called an amorphous polyester resin in the present disclosure.

One example of measuring conditions of X-ray diffraction will be described below.

(Measuring Conditions)
Tension kV: 45 kV
Current: 40 mA
MPSS
Upper
Gonio
Scan mode: continuous
Start angle: 3 degrees
End angle: 35 degrees
Angle Step: 0.02 degrees
Lucident beam optics
Divergence slit: Div slit 1/2
Difflection beam optics
Anti scatter slit: As Fixed 1/2
Receiving slit: Prog rec slit —Polyvalent Alcohol—

The polyvalent alcohol is not particularly limited and may be appropriately selected depending on the intended purpose. Examples of the polyvalent alcohol include diol and trivalent or higher alcohol.

Examples of the diol include saturated aliphatic diol. Examples of the saturated aliphatic diol include straight chain saturated aliphatic diol and branched saturated aliphatic diol. Among the above-listed examples, straight chain saturated aliphatic diol is preferable and straight chain saturated aliphatic diol having 2 or more but 12 or less carbon atoms is more preferable.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among the above-listed examples, ethylene glycol, 1,4-butanediol, 1,6-hexanediol, 1,8-octanediol, 1,10-decanediol, and 1,12-dodecanediol are preferable because a resultant crystalline polyester resin has high crystallinity and excellent sharp-melt properties.

Examples of the trivalent or higher alcohol include glycerin, trimethylolethane, trimethylolpropane, and pentaerythritol. The above-listed examples may be used alone or in combination.

—Polyvalent Carboxylic Acid—

The polyvalent carboxylic acid is not particularly limited and may be appropriately selected depending on the intended purpose. Examples of the polyvalent carboxylic acid include divalent carboxylic acid and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid, such as dibasic acid (e.g., phthalic acid, isophthalic acid, terephthalic acid, naphthalene-2,6-dicarboxylic acid, malonic acid, and mesaconic acid); and anhydrides or lower (the number of carbon atoms: from 1 through 3) alkyl ester of the above-listed divalent carboxylic acids.

Examples of the trivalent or higher carboxylic acid include 1,2,4-benzenetrivarboxylic acid, 1,2,5-benzenetricarboxylic acid, 1,2,4-naphthalenecarboxylic acid, anhydrides or lower (the number of carbon atoms: from 1 through 3) alkyl ester of the above-listed trivalent or higher carboxylic acids.

Moreover, the polyvalent carboxylic acid may include dicarboxylic acid including a sulfonic acid group, in addition to the saturated aliphatic dicarboxylic acid or aromatic dicarboxylic acid. Furthermore, in addition to the saturated aliphatic dicarboxylic acid or aromatic dicarboxylic acid, the polyvalent carboxylic acid may include dicarboxylic acid including a double bond. The above-listed examples may be used alone or in combination.

The crystalline polyester resin is preferably formed of straight chain saturated aliphatic dicarboxylic acid having 4 or more but 12 or less carbon atoms and straight chain saturated aliphatic diol having 2 or more but 12 or less carbon atoms. Specifically, the crystalline polyester resin preferably has a constitutional unit derived from saturated aliphatic dicarboxylic acid having 4 or more but 12 or less carbon atoms and a constitutional unit derived from saturated aliphatic diol having 2 or more but 12 or less carbon atoms. Such a crystalline polyester resin is preferable because crystallinity thereof is high and sharp melt properties thereof are excellent, and therefore excellent low-temperature fixing ability can be exhibited.

A melting point of the crystalline polyester resin is not particularly limited and may be appropriately selected depending on the intended purpose. The melting point of the crystalline polyester resin is preferably 60 degrees Celsius or higher but 80 degrees Celsius or lower. When the melting point is lower than 60 degrees Celsius, the crystalline polyester resin tends to melt at a low temperature to deteriorate heat resistance storage stability of the toner. When the melting point is higher than 80 degrees Celsius, the crystalline polyester resin melts insufficiently by heating at the time of fixing to thereby deteriorate low-temperature fixing ability.

A molecular weight of the crystalline polyester resin is not particularly limited and may be appropriately selected depending on the intended purpose. In view of a fact that a sharp molecular weight distribution and low molecular weight give excellent low-temperature fixing ability and a large amount of a low molecular weight component degrades heat resistant storage stability, an ortho-dichlorobenzene soluble component of the crystalline polyester resin preferably has a weight average molecular weight (Mw) of from 3,000 through 30,000, a number average molecular weight (Mn) of from 1,000 through 10,000, and Mw/Mn of from 1.0 through 10, as measured by GPC. Moreover, the weight average molecular weight (Mw) is preferably from 5,000 through 15,000, the number average molecular weight (Mn) is preferably from 2,000 through 10,000, and Mw/Mn is preferably from 1.0 through 5.0.

An acid value of the crystalline polyester resin is not particularly limited and may be appropriately selected depending on the intended purpose. In order to achieve desired low-temperature fixing ability in view of affinity between paper and a resin, the acid value thereof is preferably 5 mgKOH/g or greater, and more preferably 10 mgKOH/g or greater. In order to improve hot offset resistance, on the other hand, the acid value thereof is preferably 45 mgKOH/g or less.

A hydroxyl value of the crystalline polyester resin is not particularly limited and may be appropriately selected depending on the intended purpose. In order to achieve desirable low-temperature fixing ability and excellent charging characteristics, the hydroxyl value thereof is preferably from 0 mgKOH/g through 50 mgKOH/g and more preferably from 5 mgKOH/g through 50 mgKOH/g.

A molecular structure of the crystalline polyester resin can be confirmed by X-ray diffraction spectroscopy, GC/MS, LC/MS, and IR spectroscopy as well as liquid or solid NMR. Examples of a simple method thereof include method where a resin having absorption based on delta CH (out plane bending) of olefin at 965 $cm^{-1}$ plus/minus 10 $cm^{-1}$ or 990 $cm^{-1}$ plus/minus 10 $cm^{-1}$ in the infrared absorption spectrum is detected as a crystalline polyester resin.

An amount of the crystalline polyester resin is not particularly limited and may be appropriately selected depending on the intended purpose. The amount thereof is preferably from 1 part by mass through 10 parts by mass and more preferably from 2 parts by mass through 4 parts by mass relative to 100 parts by mass of the toner.

<Other Components>

In addition to the above-mentioned components, the toner of the present disclosure may include other components, such as a release agent, a colorant, a charge-controlling agent, external additives, a flowability improving agent, a cleaning improving agent, and a magnetic material, according to the necessity.

—Release Agent—

The release agent is not particularly limited and may be appropriately selected from release agents known in the art.

Examples of wax-based release agents include natural wax, such as vegetable-based wax (e.g., carnauba wax, cotton wax, Japan wax, and rice wax), animal-based wax (e.g., bees wax and lanolin), mineral-based wax (e.g., ozokerite and selsyn), and petroleum wax (e.g., paraffin, microcrystalline wax, and petrolatum).

In addition to the natural wax, moreover, examples include synthetic hydrocarbon wax (e.g., Fischer-Tropsch wax, polyethylene, and polypropylene) and synthetic wax (e.g., ester, ketone, and ether).

Furthermore, a fatty acid amide-based compound (e.g., 12-hydroxystearic acid amide, stearic acid amide, anhydrous phthalic acid imide, and chlorinated hydrocarbon), a homopolymer of polyacrylate that is a low molecular weight crystalline polymer resin (e.g., poly-n-stearylmethacrylate and poly-n-laurylmethacrylate) or copolymer thereof (e.g., a copolymer of n-stearylacrylate and ethyl methacrylate), and a crystalline polymer having a long alkyl group in a side chain thereof.

Among the above-listed examples, hydrocarbon-based wax, such as paraffin wax, microcrystalline wax, Fischer-Tropsch wax, polyethylene wax, and polypropylene wax, is preferable.

A melting point of the release agent is not particularly limited and may be appropriately selected depending on the intended purpose. The melting point of the release agent is preferably from 60 degrees Celsius through 80 degrees Celsius.

An amount of the release agent is not particularly limited and may be appropriately selected depending on the intended purpose. The amount of the release agent is preferably from 2 parts by mass through 10 parts by mass and more preferably from 3 parts by mass through 8 parts by mass relative to 100 parts by mass of the toner.

—Colorant—

The colorant is not particularly limited and may be appropriately selected depending on the intended purpose.

Examples of the colorant include carbon black, a nigrosine dye, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), Vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, antraquinone violet, chrome green, zinc green, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited and may be appropriately selected depending on the intended purpose. The amount of the colorant is preferably from 1 part by mass through 15 parts by mass and more preferably from 3 parts by mass through 10 parts by mass relative to 100 parts by mass of the toner.

The colorant may be used as a master batch, in which the colorant forms a composite with a resin. Examples of a resin used for production of the master batch or a resin kneaded with the master batch include, in addition to the polyester resin, styrene or a polymer of substituted styrene (e.g., polystyrene, poly-p-chlorostyrene, and polyvinyl toluene), styrene-based copolymers (e.g., a styrene-p-chlorostyrene copolymer, a styrene-propylene copolymer, a styrene-vinyl toluene copolymer, a styrene-vinyl naphthaline copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl alpha-chloromethacrylate copolymer, a styrene-acrylonitrile copolymer, a styrene-methyl vinyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer), polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, a polyacrylic acid resin, rosin, modified rosin, a terpene resin, an aliphatic or alicyclic hydrocarbon resin, an aromatic-based petroleum resin, chlorinated paraffin, and paraffin wax.

The above-listed examples may be used alone or in combination.

The master batch can be produced by mixing a resin for a master batch and a colorant with applying high shearing face and kneading the mixture. At the time of the production, an organic solvent may be used for enhancing the interaction between the colorant and the resin. Moreover, a so-called flashing method is preferably used, since a wet cake of the colorant can be directly used without being dried. The flashing method is a method in which an aqueous paste containing a colorant is mixed or kneaded with a resin and an organic solvent, and then the colorant is transferred to the resin to remove the moisture and the organic solvent. For the mixing and kneading, a high-shearing disperser, such as a three-roll mill, is preferably used.

—Charge-Controlling Agent—

The charge-controlling agent is not particularly limited and may be appropriately selected depending on the intended purpose. Example of the charge-controlling agent include nigrosine-based dyes, triphenylmethane-based dyes, chrome-containing metal complex dyes, molybdic acid chelate pigments, rhodamine-based dyes, alkoxy-based amine, quaternary ammonium salts (including fluorine-modified quaternary ammonium salts), alkyl amide, phosphorous alone or phosphorous compounds, fluorine-based active agents, salicylic acid metal salts, and metal salts of salicylic acid derivatives.

Specific examples thereof include: nigrosine dye BONTRON 03, quaternary ammonium salt BONTRON P-51, metal-containing azo dye BONTRON S-34, oxy-naphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, and quaternary ammonium salt.

An amount of the charge controlling agent is not particularly limited and may be appropriately selected depending on the intended purpose. The amount of the charge controlling agent is preferably from 0.1 parts by mass through 10 parts by mass and more preferably 0.2 parts by mass through 5 parts by mass relative to 100 parts by mass of the toner.

(Additive)

As the additive, two or more kinds of inorganic particles are added. One kind of the additive is silica. The additive is appropriately selected from additives known in the art by selecting two or more kinds of additives depending on the intended purpose. Examples of the additives include hydrophobic silica particles, fatty acid metal salts (e.g., zinc stearate and aluminium stearate), metal oxide (e.g., titania, alumina, tin oxide, and antimony oxide) or hydrophobic products thereof, and fluoropolymers. Among the above-listed examples, hydrophobic silica particles, titania particles, and hydrophobic titania particles are preferable.

Examples of the hydrophobic silica particles include: HDK H2000T, HDK H2000/4, HDK H2050EP, HVK21, and HDK H1303VP (all available from Clariant Japan K.K.); and R972, R974, RX200, RY200, R202, R805, R812, and NX90G (all available from NIPPON AEROSIL CO., LTD.).

Examples of the titania particles include: P-25 (available from NIPPON AEROSIL CO., LTD.); STT-30 and STT-65C-S(both available from Titan Kogyo, Ltd.); TAF-140 (available from Fuji Titanium Industry Co., Ltd.); and MT-150W, MT-500B, MT-600B, MT-150A (all available from TAYCA CORPORATION).

Examples of the hydrophobic titania particles include: T-805 (available from NIPPON AEROSIL CO., LTD.); STT-30A and STT-65S-S(both available from Titan Kogyo, Ltd.); TAF-500T and TAF-1500T (both available from Fuji Titanium Industry Co., Ltd.); MT-100S, MT-100T, and MT-150AFM (all available from TAYCA CORPORATION); and IT-S(available from ISHIHARA SANGYO KAISHA, LTD.).

<Production Method of Toner>

A production method of the toner is not particularly limited and may be appropriately selected depending on the intended purpose. The toner is preferably produced by dispersing, in an aqueous medium, an oil phase including a polyester resin component and optionally the crystalline polyester resin, a release agent, and a colorant to atomize a toner.

Moreover, the toner is more preferably produced by dispersing, in an aqueous medium, an oil phase including, as the polyester resin component, a polyester resin having a urethane bond and/or urea bond, preferably a polyester resin that is a prepolymer having a urethane bond and/or urea bond, and optionally the crystalline polyester resin, the curing agent, a release agent, and a colorant to atomize a toner.

Examples of such a production method of the toner include a dissolution suspension method known in the art.

As one example of the production method, a method for forming toner base particles with generating a polyester resin through an elongation reaction and/or cross-linking reaction between the prepolymer and the curing agent will be described.

In this method, preparation of an aqueous medium, preparation of an oil phase including toner materials, emulsification or dispersion of the toner materials, and removal of an organic solvent are performed.

—Preparation of Aqueous Medium (Aqueous Phase)—

For example, preparation of the aqueous phase can be performed by dispersing resin particles in an aqueous medium. An amount of the resin particles in the aqueous medium is not particularly limited and may be appropriately selected depending on the intended purpose. The amount thereof is preferably from 0.5 parts by mass through 10 parts by mass relative to 100 parts by mass of the aqueous medium.

The aqueous medium is not particularly limited and may be appropriately selected depending on the intended purpose. Examples of the aqueous medium include water, a solvent miscible with water, and a mixture thereof. The above-listed examples may be used alone or in combination. Among the above-listed examples, water is preferable.

The solvent miscible with water is not particularly limited and may be appropriately selected depending on the intended purpose. Examples of the solvent miscible with water include alcohol, dimethyl formamide, tetrahydrofuran, cellosolves, and lower ketones. Examples of the alcohol include methanol, isopropanol, and ethylene glycol. Examples of the lower ketones include acetone and methyl ethyl ketone.

—Preparation of Oil Phase—

The preparation of an oil phase including toner material in the present embodiment can be performed by dissolving or dispersion, in an organic solvent, toner materials including a polyester resin having a urethane bond and/or urea bond, and optionally a polyester resin that is a prepolymer having a urethane bond and/or urea bond, the crystalline polyester resin, a curing agent, a release agent, and a colorant.

The organic solvent is not particularly limited and may be appropriately selected depending on the intended purpose. The organic solvent is preferably an organic solvent having a boiling point of lower than 150 degrees Celsius because of easy removal thereof.

Examples of the organic solvent having a boiling point of lower than 150 degrees Celsius include toluene, xylene, benzene, carbon tetrachloride, methylene chloride, 1,2-dichloroethane, 1,1,2-trichloroethane, trichloroethylene, chloroform, monochrome benzene, dichloroethylidene, methyl acetate, ethyl acetate, methyl ethyl ketone, and methyl isobutyl ketone.

The above-listed examples may be used alone or in combination.

Among the above-listed examples, ethyl acetate, toluene, xylene, benzene, methylene chloride, 1,2-dichloroethane, chloroform, and carbon tetrachloride are preferable, and ethyl acetate is more preferable.

—Emulsification or Dispersion—

The emulsification or dispersion of the toner materials can be performed by dispersing the oil phase including the toner materials in the aqueous medium. At the time of the emulsification or dispersion of the toner materials, the curing agent and the prepolymer can be allowed to react through an elongation reaction and/or cross-linking reaction.

The reaction conditions (e.g., a reaction duration and a reaction temperature) for generating the prepolymer are not particularly limited and may be appropriately selected depending on a combination of the curing agent and the prepolymer. The reaction duration is preferably from 10 minutes through 40 hours, and more preferably from 2 hours through 24 hours. The reaction temperature is preferably from 0 degrees Celsius through 150 degrees Celsius, and more preferably from 40 degrees Celsius through 98 degrees Celsius.

A method for stably forming a dispersion liquid including the prepolymer in the aqueous medium is not particularly limited and may be appropriately selected depending on the intended purpose. Examples of the method include a method where adding an oil phase, which is prepared by dissolving or dispersing toner materials, into an aqueous phase and dispersing the resultant mixture with shearing force.

A disperser used for the dispersing is not particularly limited and may be appropriately selected depending on the intended purpose. Examples of the disperser include a low-speed shearing disperser, a high-speed shearing disperser, a friction disperser, a high-pressure jet disperser, and an ultrasonic disperser. Among the above-listed examples, a high-speed shearing disperser is preferable because particle diameter of dispersed elements (oil droplets) can be controlled to the range of from 2 micrometers through 20 micrometers.

In the case where the high-speed shearing disperser is used, conditions, such as rotational speed, dispersion duration, and a dispersion temperature, are appropriately selected depending on the intended purpose. The rotational speed is preferably from 1,000 rpm through 30,000 rpm and more preferably from 5,000 rpm through 20,000 rpm. In case of a batch system, the dispersion duration is preferably from 0.1 minutes through 5 minutes. The dispersion temperature is preferably from 0 degrees Celsius through 150 degrees and more preferably from 40 degrees Celsius through 98 degrees Celsius under pressure. Generally, dispersion is easily performed when the dispersion temperature is high.

An amount of the aqueous medium used when the toner materials are emulsified or dispersed is not particularly limited and may be appropriately selected depending on the intended purpose. The amount thereof is preferably from 50 parts by mass through 2,000 parts by mass and more preferably from 100 parts by mass through 1,000 parts by mass relative to 100 parts by mass of the toner materials.

When the oil phase including the toner materials is emulsified or dispersed, a dispersant is preferably used in order to stabilize dispersed elements, such as oil droplets and make a particle size distribution sharp as well as making desired particle shapes.

The dispersant is not particularly limited and may be appropriately selected depending on the intended purpose. Examples of the dispersant include a surfactant, a water-insoluble inorganic compound dispersing agent, and a polymer protective colloid. The above-listed examples may be used alone or in combination. Among the above-listed examples, a surfactant is preferable.

The surfactant is not particularly limited and may be appropriately selected depending on the intended purpose. For example, an anionic surfactant, a cationic surfactant, a nonionic surfactant, or an amphoteric surfactant can be used. Examples of the anionic surfactant include alkyl benzene sulfonic acid salts, alpha-olefin sulfonic acid salts, and phosphoric acid esters. Among the above-listed examples, a surfactant having a fluoroalkyl group is preferable.

—Removal of Organic Solvent—

A method for removing the organic solvent from the dispersion liquid, such as the emulsified slurry, is not particularly limited and may be appropriately selected depending on the intended purpose. Examples of the method include: a method where an entire reaction system is gradually heated to evaporate an organic solvent in oil droplets; and a method where a dispersion liquid is sprayed in a dry atmosphere to remove an organic solvent in oil droplets.

When the organic solvent is removed, toner base particles are formed. The toner base particles can be washed and dried, and moreover, the toner base particles can be classified. The classification may be performed by removing an additive component in a liquid through use of a cyclon, a decanter, or centrifugal separation. Alternatively, the operation of the classification may be performed after the drying.

The obtained toner base particles may be mixed with particles, such as the external additives and the charge-controlling agent. A mechanical impact is applied during the mixing to thereby prevent the particles, such as the external additives, from separating from surfaces of the toner base particles.

A method for applying the mechanical impact is not particularly limited and may be appropriately selected depending on the intended purpose. Examples of the method include: a method where an impact is applied to the mixture using a blade that rotates at high speed; and a method where the mixture is introduced into a high-speed air flow and the speed is increased to allow the particles to crash one another or allow the particles to crush into an appropriate impact board.

A device used in the above-mentioned method is not particularly limited and may be appropriately selected depending on the intended purpose. Examples of the device include an angmill (available from Hosokawa Micron Corporation), a device the pul-verization air pressure of which is reduced by modifying an I-type mill (available from NIPPON PNEUMATIC MFG. CO., LTD.), a hybridization system (available from NARA MACHINERY CO., LTD.), Cliptron System (available from Kawasaki Heavy Industries, Ltd.), and an automatic mortar.

(Developer)

The developer of the present disclosure includes at least the toner of the present disclosure, and may further include appropriately selected other components, such as a carrier, according to the necessity. Since the developer includes the toner of the present disclosure, the developer has excellent transfer properties and charging properties and images of high image quality can be stably formed. Note that, the developer may be a one-component developer or two-component developer. In the case where the developer is used in a high-speed printer corresponding to a recent improvement of image processing speed, the developer is preferably a two-component developer because a service life is improved.

When the developer is used as a one-component developer, variations in particle diameters of the toner are small when the toner is consumed and the developer is supplemented with a fresh toner, filming of the toner to a developing roller or fusion of the toner to a member, such as a blade for making a toner layer thin is suppressed, and excellent and stable developing properties and images can be obtained even when the developer is stirred for a lone period in a developing device.

In the case where the developer is used as a two-component developer, variations in particle diameters of the toner is small when the consumption and supplement of the toner is performed over a long period, and excellent and stable developing properties and images can be obtained even when the developer is stirred for a long period in a developing device.

<Carrier>

The carrier is not particularly limited and may be appropriately selected depending on the intended purpose. The carrier is preferably a carrier including carrier particles in each of which a core is covered with a resin layer.

—Cores—

A material of the cores is not particularly limited and may be appropriately selected depending on the intended purpose. Examples of the material include a manganese-strontium-based material of from 50 emu/g through 90 emu/g and a manganese-magnesium-based material of form 50 emu/g through 90 emu/g. In order to secure sufficient image density, moreover, use of a high magnetic material, such as an iron powder of 100 emu/g or greater or magnetite of from 75 emu/g through 120 emu/g is preferable. Moreover, use of a low magnetic material, such as a copper-zinc-based material of from 30 emu/g through 80 emu/g is preferable because an impact of the developer against a photoconductor can be softened and high image quality can be obtained.

The above-listed examples may be used alone or in combination.

A volume average particle diameter of the cores is not particularly limited and may be appropriately selected depending on the intended purpose. The volume average particle diameter thereof is preferably from 10 micrometers through 150 micrometers, and more preferably from 40 micrometers through 100 micrometers.

The toner of the present disclosure can be used for a two-component developer by mixing with the carrier.

An amount of the carrier in the two-component developer is not particularly limited and may be appropriately selected depending on the intended purpose. The amount of the carrier is preferably from 90 parts by mass through 98 parts by mass, and more preferably from 93 parts by mass through 97 parts by mass, relative to 100 parts by mass of the two-component developer.

The developer of the present disclosure can be suitably used for image formation performed according to any of various electrophotographic methods known in the art, such as a magnetic one-component developing method, a non-magnetic one-component developing method, and a two-component developing method.

(Image Forming Apparatus and Image Forming Method)

The image forming apparatus of the present disclosure includes an image bearer where a latent image is to be formed on the image bearer and the image bearer can bear a toner image, a developing unit configured to develop a latent image formed on the image bearer with a toner to form the toner image, an intermediate transfer member, on which the toner image formed through the development performed by the developing unit is primary transferred, and a secondary transfer member configured to secondary transfer the toner image born on the intermediate transfer member to a recording medium. The image forming apparatus may further include appropriately selected other units, such as a charge-eliminating unit, a cleaning unit, a recycling unit, and a controlling unit, according to the necessity.

The intermediate transfer member used in the image forming apparatus is the above-described intermediate transfer member of the present disclosure.

Moreover, the toner used in the image forming apparatus is the above-described toner of the present disclosure.

Furthermore, the image forming apparatus is preferably an image forming apparatus where the image forming apparatus is a full-color image forming apparatus and the image forming apparatus includes a plurality of the image bearers each including the developing unit of each color where the image bearers are arranged in series.

The image forming method of the present disclosure include a developing step, a primary transferring step, and a secondary transferring step. The developing step includes developing a latent image formed on an image bearer with a toner to form the toner image where the image bearer is an image bearer capable of bearing a toner image. The primary transferring step includes primary transferring the toner image developed in the developing step to an intermediate transfer member. The secondary transferring step includes secondary transferring the toner image born on the intermediate transfer member to a recording medium. The image forming method may further include other steps according to the necessity.

The intermediate transfer member used in the image forming method is the above-described intermediate transfer member of the present disclosure.

Moreover, the toner used in the image forming method is the above-described toner of the present disclosure.

The intermediate transfer member (with taking an intermediate transfer belt, which is a preferable embodiment of the present disclosure, as an example) used in a belt component mounted in the image forming apparatus will be specifically described hereinafter with reference to a schematic view of a main area. Note that, the schematic view illustrates one example and is not construed as to limit the scope of the present disclosure.

FIG. 4 is a main area schematic view illustrating an image forming apparatus, in which the intermediate transfer belt (seamless belt) obtained by the production method according to the present disclosure is mounted as a belt member.

An intermediate transfer unit 500 including the belt member illustrated in FIG. 4 includes an intermediate transfer belt 501 that is an intermediate transfer member supported by a plurality of rollers. Around the intermediate transfer belt 501, a secondary transfer bias roller 605 that is a secondary transfer charge applying unit of the secondary transfer unit 600, a belt cleaning blade 504 that is an intermediate transfer member cleaning unit, and a lubricant application brush 505 that is a lubricant application member of a lubricant applying unit are arranged to face the intermediate transfer belt.

Moreover, a position detection mark that is not illustrated is disposed on an outer circumferential surface or inner circumferential surface of the intermediate transfer belt 501. When a position detection mark is disposed on an outer circumferential surface of the intermediate transfer belt 501, however, the position detection mark needs to be well designed to avoid a traveling region of the belt cleaning blade 504 and therefore it is difficult to arrange the position detection mark. In such a case, the position detection mark may be arranged on the inner circumferential surface of the intermediate transfer belt 501. An optical sensor 514 serving as a mark detection sensor is arranged in a position between the primary transfer bias roller 507 and the belt driving roller 508 by which the intermediate transfer belt 501 is supported.

The intermediate transfer belt 501 is supported by the primary transfer bias roller 507 that is a primary transfer charge applying unit, the belt driving roller 508, a belt tension roller 509, a secondary transfer counter roller 510, a cleaning counter roller 511, and a feedback electric current detection roller 512. Each of the above-mentioned rollers is formed of a conductive material. Each of the above-mentioned rollers, other than the primary transfer bias roller 507, is earthed. Transfer bias is applied to the primary transfer bias roller 507. The electric current or voltage of the transfer bias is controlled to the predetermined value by a primary transfer power source 801 depending on the number of toner images superimposed.

The intermediate transfer belt 501 is driven in the direction of the arrow by the belt driving roller 508 that is rotatably driven in the direction of the arrow by a driving motor that is not illustrated.

The intermediate transfer belt 501 that is a belt member is typically a semiconductor or insulator and has a single layer or multiple layer structure. In the present disclosure, a seamless belt is preferably used as the intermediate transfer belt. Use of the seamless belt improves durability and realizes excellent image formation. In order to superimpose toner images formed on the photoconductor drum 200 onto the intermediate transfer belt, moreover, the intermediate transfer belt is designed to be larger than the maximum feeding size.

The secondary transfer bias roller 605 that is a secondary transfer member is arranged in a manner that the secondary transfer bias roller can be in contact with and separated from an area of an outer circumferential surface of the intermediate transfer belt 501 by a contact-separation mechanism serving as the below-mentioned contact-separation unit. The area of the outer circumferential surface is an area thereof supported by the secondary transfer counter roller 510. The secondary transfer bias roller 605 is arranged to nip transfer paper P, which is a recording medium, with the area of the intermediate transfer belt 501 supported by the secondary transfer counter roller 510. Transfer bias of the predetermined electric current is applied to the secondary transfer bias roller by a secondary transfer power source 802 electric current of which is controlled to be constant.

The registration roller 610 is configured to feed the transfer paper P that is a transfer material at the predetermined timing between the secondary transfer bias roller 605 and the intermediate transfer belt 501 supported by the secondary transfer counter roller 510. Moreover, the cleaning blade 608 that is a cleaning unit is brought into contact with the secondary transfer bias roller 605. The cleaning blade 608 is configured to remove depositions on the surface of the secondary transfer bias roller 605 to clean the secondary transfer bias roller.

In FIG. 4, the numeral reference 70 represents a charge-eliminating roller, the numeral reference 80 represents an earth roller, the numeral reference 204 represents a potential sensor, the numeral reference 205 represents an image density sensor, the numeral reference 503 represents a charger, and the numeral reference 513 represents a toner image.

Once an image formation cycle starts in the color copier of the above-described structure, the photoconductor drum 200 is rotated in the anti-clockwise direction indicated with the arrow by a driving motor that is not illustrated to perform Bk (black) toner image formation, C (cyan) toner image formation, M (magenta) toner image formation, and Y (yellow) toner image formation are performed on the photoconductor drum 200. The intermediate transfer belt 501 is rotated in the clockwise direction indicated with the arrow by the belt driving roller 508. Along the rotation of the intermediate transfer belt 501, the Bk toner image, the C toner image, the M toner image, and the Y toner image are primary transferred by transfer bias generated by voltage applied to the primary transfer bias roller 507. Ultimately, all of the toner images are superimposed on the intermediate transfer belt 501 in the order of Bk, C, M, and Y.

For example, the Bk toner image formation is performed in the following manner.

In FIG. 4, the charger 203 uniformly charge a surface of the photoconductor drum 200 to the predetermined potential with negative charge through corona discharge. The timing for exposure is determined based on the belt mark detection signal and raster exposure of laser light is performed by a writing optical unit that is not illustrated based on the Bk color image signal. When the exposure of the raster image is performed, the exposed area on the surface of the photoconductor drum 200, which has been originally uniformly charged, loses the charge in proportional to the exposure light dose to form a Bk electrostatic latent image. When the negatively charged Bk toner on a developing roller of the Bk developing device 231K is brought into contact with the Bk electrostatic latent image, the toner is not deposited on an area where potential of the photoconductor drum 200 remains and the toner is attracted on an area of no potential, i.e., the exposed area, to thereby form a BK toner image corresponding to the electrostatic latent image.

The Bk toner image formed on the photoconductor drum 200 in the above-described manner is primary transferred to a belt outer circumferential surface of the intermediate transfer belt 501 driven to rotate at the same speed as the rotation of the photoconductor drum 200 in the state where the intermediate transfer belt 501 and the photoconductor drum 200 are in contact with each other. After the primary transfer, a slight amount of the untransferred toner remained on the surface of the photoconductor drum 200 is cleaned by a photoconductor cleaning device 201 to make the photoconductor drum 200 ready for use again. The photoconductor drum 200 enters a C image formation step after the Bk image formation step. Reading of the C image data by a color scanner starts at the predetermined timing, and laser light writing is performed based on the C image data to thereby form a C electrostatic latent image on the surface of the photoconductor drum 200.

After the rear edge of the Bk electrostatic latent image passes but before the top edge of the C electrostatic latent image reaches, a rotational operation of a revolver developing unit 230 is performed, a C developing device 231C is set in a developing position, and the C electrostatic latent image is developed with a C toner. Thereafter, developing of the C electrostatic latent image region is continued. Similarly to the case of the previous Bk developing device 231K, the rotational operation of revolver developing unit is performed when the rear edge of the C electrostatic latent image passes, and a sequential M developing device 231M is moved to the developing position. The operation as mentioned is completed before a top edge of a Y electrostatic latent image reaches the developing position. Note that, descriptions of the M and Y image formation steps are omitted because each operation of reading color image data, an electrostatic latent image formation, and developing is identical to the operation in the above-mentioned Bk and C steps.

The Bk, C, M and Y toner images sequentially formed on the photoconductor drum 200 in the above-described manner are sequentially positioned on the identical surface of the intermediate transfer belt 501 to perform primary transfer. As a result, a toner image in which at the maximum four colors are superimposed is formed on the intermediate transfer belt 501. Meanwhile, transfer paper P is fed from a paper feeding unit, such as a transfer paper cassette or a manual paper feeding tray at the time when the image formation operation is started, and the transfer paper P waits at a nip with the registration roller 610.

When a top edge of the toner image on the intermediate transfer belt 501 enters a secondary transfer section at which a nip is formed with the intermediate transfer belt 501 supported by the secondary transfer counter roller 510 and the secondary transfer bias roller 605, the registration roller 610 is driven to make the top edge of the transfer paper P and the top edge of the toner image meet with each other, the transfer paper P is transported along the transfer paper guide plate 601 to perform registration of the transfer paper P and the toner image.

Once the transfer paper P passes through the secondary transfer section in the above-described manner, the four color-superimposed toner image on the intermediate transfer belt 501 is collectively transferred (secondary transfer) onto the transfer paper P by transfer bias generated by voltage applied to the secondary transfer bias roller 605 from the secondary transfer power source 802. The transfer paper P is then transported along the transfer paper guide plate 601, the charge of the transfer paper P is removed by passing a counter section with the transfer paper charge-eliminating charger 606 formed of a charge elimination needle arranged at the downstream of the secondary transfer section. Thereafter, the transfer paper P is sent to the fixing device 270 by the belt conveying device 210 that is a belt structure unit. After melting and fixing the toner image on the transfer paper P at the nip between the fixing rollers 271 and 272 of the fixing device 270, the transfer paper P is ejected from the device main body by a discharge roller that is not illustrated and is then stacked with the printed surface upwards on a copy tray that is not illustrated. Note that, the fixing device 270 may include a belt structure unit according to the necessity.

Meanwhile, the surface of the photoconductor drum 200 after the belt transfer is cleaned by the photoconductor cleaning device 201 and the charge of the surface of the photoconductor drum is uniformly eliminated by the charge-eliminating lamp 202. Moreover, the residual toner remained on the outer circumferential surface of the intermediate transfer belt 501 after secondary transferring the toner image to the transfer paper P is cleaned by the belt cleaning blade 504. The belt cleaning blade 504 is constructed in a manner that the belt cleaning blade is brought into contact with or separated from the outer circumferential surface of the intermediate transfer belt 501 at the predetermined timing by a cleaning member contact-separation system that is not illustrated.

A toner sealing member 502 that is brought into contact with or separated from the outer circumferential surface of the intermediate transfer belt 501 is disposed at the upstream of the belt cleaning blade 504 relative to the traveling direction of the intermediate transfer belt 501. The toner sealing member 502 is configured to receive the toner fell from the belt cleaning blade 504 at the time of cleaning of the residual toner to prevent the fallen toner from scattering over the transporting path of the transfer paper P. The toner sealing member 502 is brought into contact with and separated from the outer circumferential surface of the intermediate transfer belt 501 together with the belt cleaning blade 504 by the cleaning member contact-separation system.

To the outer circumferential surface of the intermediate transfer belt 501 from which the residual toner has been removed in the above-described manner, a lubricant 506 scraped by the lubricant applying brush 505 is applied. For example, the lubricant 506 is formed of a solid, such as zinc stearate, and the lubricant is arranged to be in contact with the lubricant applying brush 505. Moreover, the residual potential remained on the outer circumferential surface of the intermediate transfer belt 501 is removed by charge eliminating bias applied by a belt charge-eliminating brush that is not illustrated and is in contact with the outer circumferential surface of the intermediate transfer belt 501. The lubricant applying brush 505 and the belt charge-eliminating brush are each arranged in a manner that each is brought into contact with and separated from the intermediate transfer belt 501 at the predetermined timing by a contact-separation mechanism that is not illustrated.

At the time when an operation of copying is repeated, an operation of a color scanner and image formation onto the photoconductor drum 200 proceed to an image forming step of a first color (Bk) of second copy at the predetermined timing following the image forming step of the $4^{th}$ color (Y) of the first copy. Subsequent to the collective transfer step of the 4-color superimposed toner image of the first copy to the transfer paper, the intermediate transfer belt 501 is configured to receive first transfer of a Bk toner image of the second copy in the region of the outer circumferential surface of the belt cleaned by the belt cleaning blade 504. Thereafter, the same operations to those of the first copy are repeated. The image formation of the copy mode to obtain a 4-color full-color copy has been described above. In case of a 3-color copy mode or 2-color copy mode, the same operations are performed with the designated colors by the number to be repeated. In case of a single color copy mode, moreover, only the developing device of the predetermined color of the revolver developing unit 230 is set in the developing operation state during the predetermined number of sheets for copying are completed, and the operation of copying is performed in the state where the belt cleaning blade 504 is remained in contact with the intermediate transfer belt 501.

In the embodiment above, the copier equipped with only one photoconductor drum has been described. The present disclosure however can be applied to an image forming apparatus where a plurality of photoconductor drums are aligned in series along one intermediate transfer belt, for example, as illustrated as one structural example, in a main area schematic view of FIG. 5.

FIG. 5 illustrates one structural example of 4-drum digital color printer equipped with 4 photoconductor drums 21Bk, 21Y, 21M, and 21C for forming toner images of 4 different colors (black, yellow, magenta, and cyan).

In FIG. 5, the printer main body 10 includes an image writing unit 12, an image forming unit 13, a paper feeding unit 14, which are configured to perform color image formation in an electrophotographic system. Image processing is performed by the image processing unit based on image signals to convert the signals into a signal of each color of black (Bk), magenta (M), yellow (Y), and cyan (C) for image formation. The converted signal is transmitted to the image writing unit 12. For example, the image writing unit 12 is a laser scanning optical system including a laser light source, a deflector (e.g., a rotary polygon mirror), a scanning image forming optical system, and a group of mirrors. The image writing unit 12 has four wiring light paths each corresponding to each of the color signals, and is configured to write an image corresponding to each color signal into an image bearer (photoconductor) 21BK, 21M, 21Y, or 21C that is disposed in each color of the image forming units 13.

The image forming unit 13 includes the photoconductor 21Bk, 21M, 21Y, or 21C that is each image bearer for black (Bk), magenta (M), yellow (Y), or cyan (C). As the photoconductor for each color, an OPC photoconductor is typically used. Around each photoconductor 21Bk, 21M, 21Y, or 21C, a charging device, an exposing unit of laser light from the writing unit 12, a developing device for each color of black, magenta, yellow, or cyan 20Bk, 20M, 20Y, or 20C, a primary transfer bias roller 23Bk, 23M, 23Y, or 23C serving as a primary transfer unit, a cleaning device (not indicated), a photoconductor charge-eliminating device that is not illustrated, etc. are arranged. Note that, the developing device 20Bk, 20M, 20Y, or 20C employs a two-component magnetic brush developing system. The intermediate transfer belt 22 that is a belt structure unit is present between each photoconductor 21Bk, 21M, 21Y, or 21C and each primary transfer bias roller 23Bk, 23M, 23Y, or 23C. Toner images of all colors formed on all of the photoconductors are sequentially superimposed and transferred onto the intermediate transfer belt.

Meanwhile, transfer paper P is fed from a paper feeding unit 14 and then born on a transfer conveying belt 50 that is a belt structure unit via a registration roller 16. The toner images transferred on the intermediate transfer belt 22 are secondary transferred (collectively transferred) to the transfer paper P by a secondary transfer bias roller 60 serving as a secondary transfer unit at the area where the intermediate transfer belt 22 and the transfer conveying belt 50 are brought into contact with each other. As a result, a color image is formed on the transfer paper P. The transfer paper P on which the color image has been formed is transported to a fixing device 15 by the transfer conveying belt 50, the transferred image is fixed by the fixing device 15, followed by being discharged from the main body of the printer.

Note that, the residual toner remained on the intermediate transfer belt 22 without being transferred at the time of the secondary transfer is removed from the intermediate transfer belt 22 by a belt cleaning member 25. A lubricant applying device 27 is arranged at the downstream of the belt cleaning member 25. The lubricant applying device 27 includes a solid lubricant and a conductive brush configured to rub against the intermediate transfer belt 22 to apply the solid lubricant thereto. The conductive brush is in contact with the intermediate transfer belt 22 regularly and applies the solid lubricant to the intermediate transfer belt 22. The solid lubricant has functions of enhancing cleaning properties of the intermediate transfer belt 22 and preventing filming to improve durability of the intermediate transfer belt.

Note that, in FIG. 5, the numeral reference 26 represents a driving roller.

EXAMPLES

The present disclosure will be described more detail by way of Examples. However, the present disclosure should not be construed as being limited to these Examples.

<Measurement of Each Resistivity (Value)>

A measurement of volume resistivity of particles was calculated by using MCP-PD51, LORESTA GP, and HIRESTA UP available from Mitsubishi Chemical Analytech Co., Ltd., charging a pressure container having a diameter of 15 mm with 1 g of the particles in an environment of 23 degrees Celsius and 50 percent RH, and applying load of 4 KN, followed by measuring at 20 KV and reading a value.

As resistivity of an intermediate transfer belt, moreover, values of surface resistance and volume resistivity were measured after applying bias of 500 V for 10 seconds using HIRESTA UP in an environment of 23 degrees Celsius and 50 percent RH.

<Measurement of Volume Average Particle Diameter of Toner>

A volume average particle diameter was measured by performing a measurement by means of a particle-size analyzer (Multisizer III, available from Beckman Coulter, Inc.) with an aperture diameter of 100 micrometers and analyzing using an analysis software (Beckman Coulter Mutlisizer 3, Version 3.51).

<Measurement of Average Circularity of Toner>

An Average Circularity was Determined by Performing a Measurement by Means of a flow particle image analyzer (FPIA-2100, available from SYSMEX CORPORATION) and analyzing using analysis software (FPIA-2100 Data Processing Program for FPIA version00-10). Specifically, the measurement was performed in the following manner. A 100 mL-glass beaker was charged with from 0.1 mL through 0.5 mL of 10 percent by mass surfactant (alkyl benzene sulfonate, NEOGEN SC-A, manufactured by DAI-ICHI KOGYO SEIYAKU CO., LTD.) and from 0.1 g through 0.5 g of each toner. Then, the mixture was stirred by a microspatula, followed by adding 80 mL of ion-exchanged water. The obtained dispersion liquid was subjected to a dispersion treatment for 3 minutes by means of an ultrasonic wave disperser (available from HONDA ELECTRONICS CO., LTD.). The dispersion liquid was subjected to measurements of shapes and distribution of particles of the toner by means of FPIA-2100 until a concentration of from 5,000 particles/microliter through 15,000 particles/microliter was obtained.

<Measurement of Dielectric Constant of Toner>

The toner was formed into a circular pellet having a diameter of 40 mm by pressure of 6 MPa using a molding machine in a manner that a thickness of the pellet was to be 2.0 mm plus/minus 0.1 mm. A measurement cell having an inner diameter of about 2 cm was tightly filled with the obtained pellet. The measurement cell was a nonconductor cylinder of TR-10C dielectric loss measuring instrument (available from Ando Electric Co., Ltd.), where metal electrodes having excellent conduction were disposed at the top and bottom of the cylinder respectively. A dielectric constant was determined according to an alternating current bridge method at 25 degrees Celsius in the indoor atmosphere with a measuring frequency of 1 KHz.

<Measurement of Liberation Ratio of Additive of Toner>

The additive separated from the toner were measured in the following manner.

(1) A toner sample (3.75 g) is dispersed in 50 mL of a 0.5 percent by mass poly-oxyalkylene alkyl ether (NOIGEN ET-165, DKS Co., Ltd.) dispersion liquid in a 110 mL vial.

(2) The resultant dispersion liquid was irradiated with ultrasonic waves for 100 seconds at frequency of 20 kHz and output of 40 W (40 Wx100 seconds=4 kJ) by means of a ultrasonic wave homogenizer (product name: homogenizer, type: VCX750, CV33, available from SONICS & MATERIALS). During the irradiation, the treatment was performed in a manner that the liquid temperature of the toner dispersion liquid was not to be 40 degrees Celsius or higher.

(3) The obtained dispersion liquid was subjected vacuum filtration with filter paper (product name: qualitative filter paper (No. 2, 110 mm), available from Advantec Toyo Kaisha, Ltd.). The resultant was again washed with ion-exchanged water twice, followed by filtration. After removing the separated additive in the manner as mentioned, the toner was dried.

(4) An amount of the additive of the toner before and after removing the additive was quantified by calculating a percentage by mass from a strength (or a difference in intensity before and after the removal of the external additive) of a calibration curve by a fluorescent X-ray spectrometer (ZSX-100e, available from Rigaku Corporation), to thereby determine a liberation amount of the additive.

Liberation amount=(mass of additive before dispersion)−(mass of remained additive after dispersion) <<Mathematical formula 1>>

The liberation ratio (percent by mass) of the additive was determined by the following mathematical formula 2.

Liberation ratio=[liberation amount/total added amount of additive]×100 <<Mathematical formula 2>>

The total added amount of the additive was determined as follows.

By means of the ultrasonic homogenizer, the toner was irradiated with ultrasonic waves in the irradiation energy dose of 1,000 kJ and 1,500 kJ in the same manner as described above to confirm there was no reduction in the amount of the additive between the irradiation of 1,000 kJ and the irradiation of 1,500 kJ. In a case where there was no reduction, it could be judged that all of the additive was separated from the toner.

Moreover, surfaces of the particles of the toner after the treatment were observed under a field emission scanning electron microscope (FE-SEM) to confirm that all of the additive was separated. When there was a change, the same treatment was performed with increasing the irradiation energy dose by 500 kJ.

The total added amount of the additive was calculated from a difference between the amount of the additive of the toner from which all of the additive was separated as described above and an amount of the additive of the non-treated toner.

(Production Example A)

((Production of Intermediate Transfer Belt A))

<Production of Base Layer>

The following base layer coating liquid was prepared and a base layer of a seamless intermediate transfer belt was producing using the coating liquid.

<<Preparation of Base Layer Coating Liquid>>

First, a dispersion liquid, in which carbon black (Special-Black4, available from Evonik Degussa) had been dispersed in N-methyl-2-pyrrolidone by a bead mill in advance, was added to polyimide varnish (U-varnish A, available from Ube Industries, Ltd.) including a polyimide resin precursor as a main ingredient in a manner that the carbon black content was 17 percent by mass relative to the polyamic acid solid content. The resultant was sufficiently mixed and stirred to thereby prepare a coating liquid.

<<Production of Polyimide Base Layer Belt>>

Next, a metal cylindrical support having an outer diameter of 500 mm and a length of 400 mm was used as a mold. An outer surface of the metal cylindrical support had been roughened by a blast treatment. The metal cylindrical support was mounted in a roll coater.

Subsequently, the base layer coating liquid produced above was flown into a pan, and the base layer coating liquid was taken up with a coating roller with rotational speed of 40 mm/sec. A gap between a regulation roller and the coating roller was set to 0.6 mm to control a thickness of the coating liquid on the coating roller.

Thereafter, rotational speed of the cylindrical support was controlled to 35 mm/sec and was moved close to the coating roller. The coating liquid on the coating roller was transferred and uniformly applied onto the cylindrical support with setting a gap between the coating roller and the cylindrical support to 0.4 mm. Thereafter, the resultant was placed in a hot air circulation drier with maintaining the rotation thereof and gradually heated to 110 degrees Celsius for 30 minutes. The temperature was further increased, and the resultant was heated at 200 degrees Celsius for 30 minutes and was stopped rotating. Thereafter, the resultant was introduced into a heating furnace (firing furnace) capable of performing a high-temperature treatment. A heating treatment (firing) was performed for 60 minutes with increasing a temperature stepwise to 320 degrees Celsius. The resultant was sufficiently cooled to thereby obtain Polyimide Base Layer Belt A having a film thickness of 60 micrometers.

<Production of Elastic Layer>

The following ingredients were blended in the amounts presented below and the resultant mixture was kneaded to thereby prepare a rubber composition.

Acrylic rubber (NipolAR12, available from Zeon Corporation): 100 parts by mass

Stearic acid (Beads Stearic Acid *Camellia*, available from NOF CORPORATION): 1 part by mass Red phosphorus (Novaexcel 140F, available from RIN KAGAKU KOGYO Co., Ltd.): 10 parts by mass Aluminium hydroxide (Higirite H42M, available from SHOWA DENKO K.K.): 40 parts by mass Cross-linking agent (Diak. No. 1, hexamethylenediamine carbamate, available from DuPont Dow Elastomers Japan): 0.6 parts by mass Crosslinking accelerator (VULCOFAC ACT55 (70 percent by mass of a salt of 1,8-diazobicyclo(5,4,0)undec-7-ene and dibasic acid, and 30 percent by mass of amorphous silica) available from Safic Alcan): 0.6 parts by mass Next, the obtained rubber composition was dissolved in an organic solvent (methyl isobutyl ketone, MIBK) to prepare a rubber solution having a solid content of 35 percent by mass.

The rubber solution was continuously ejected from a nozzle to the polyimide base layer of the cylindrical support to spirally apply the rubber solution with moving an axial direction of the cylindrical support, while rotating the above-produced cylindrical support, on which the polyimide base layer had been formed. As the applied amount, the rubber solution amount was adjusted in a manner that an average thickness of a final elastic layer was to be 400 micrometers. Thereafter, the cylindrical support on which the rubber solution had been applied was placed into a hot air circulation drier with maintaining the rotation, and the cylindrical support was heated for 30 minutes with increasing a temperature up to 90 degrees Celsius at heating speed of 4 degrees Celsius/min.

<Production of Conductive Particles>

Surfaces of particles of Techpolymer SSX102 (available from SEKISUI PLASTICS CO., LTD., particle diameter: 2 micrometers) that was spherical acrylic resin particles were spray coated with Denatron PT-434 (Nagase ChemteX Corporation) that was a polythiophene-based conductive polymer. Thereafter, the resultant was dried for 1 hour at 120 degrees Celsius to thereby produce Conductive Particles A. The spray coating was adjusted in a manner that final volume resistivity of the particles was to be $2.1\times10^{2}$ ohm*cm.

<Application of Particle onto Surface of Elastic Layer>

Next, Conductive Particles A were evenly scattered onto the surface of the elastic layer 32 according to the method of FIG. 3, and a press member 33 formed of a polyurethane rubber blade was pressed against Conductive Particles A with press force of 100 mN/cm to thereby fix Conductive Particles A on the surface of the elastic layer. Subsequently, the resultant was again placed in the hot air circulation drier, and a heating treatment was performed for 60 minutes with increasing a temperature to 170 degrees Celsius at heating speed of 4 degrees Celsius/min, to thereby produce Intermediate Transfer Belt A.

(Production Example B)

((Production of Intermediate Transfer Belt B))

Conductive Particles B having volume resistivity of $7.5\times10^{0}$ ohm*cm were produced in the same manner as in <Production of conductive particles> of Production Example A, except that, in <Production of conductive particles>, the process for application through spray coating and drying in the course of production of Conductive Particles A was repeated twice.

Intermediate Transfer Belt B was produced in the same manner as in Production Example A, except that Conductive Particles A were replaced with Conductive Particles B.

(Production Example C)

((Production of Intermediate Transfer Belt C))

Conductive Particles C having volume resistivity of $7.5\times10^{8}$ ohm*cm were produced in the same manner as in <Production of conductive particles> of Production Example A, except that, in <Production of conductive particles>, the process for application through spray coating and drying in the course of production of Conductive Particles A was not performed.

Intermediate Transfer Belt C was produced in the same manner as in Production Example A, except that Conductive Particles A were replaced with Conductive Particles C.

(Production Example D)

((Production of Intermediate Transfer Belt D))

Conductive Particles D were produced in the same manner as in <Production of conductive particles> of Production Example A, except that, in <Production of conductive particles>, Techpolymer SSX102 was replaced with Tospearl 2000B (available from Material Performance Materials Inc., average particle diameter: 6 micrometers) that was silicone resin particles. The volume resistivity of the particles was $5.5\times10^{5}$ ohm*cm.

Intermediate Transfer Belt D was produced in the same manner as in Production Example A, except that Conductive Particles A were replaced with Conductive Particles D.

(Production Example E)

((Production of Intermediate Transfer Belt E))

Intermediate Transfer Belt E was produced in the same manner as in Production Example A, except that Techpolymer SSX102 was used as it was instead of using Conductive Particles A. The resistivity of Techpolymer SSX102 was over the range ($1\times10^{14}$ ohm*cm or greater) since resistance was too high.

(Production Example F)

((Production of Intermediate Transfer Belt F))

Intermediate Transfer Belt was produced in the same manner as in Production Example E, except that conductive particles A were not used and a fine particle-cut product of STC-3 (available from MITSUI MINING & SMELTING CO., LTD., average particle diameter: 2.6 micrometers) that was solder powder (tin, silver, and copper) was used instead of Techpolymer SSX102. The volume resistivity of STC-3 was $3.2\times10^{-6}$ ohm*cm.

(Production Example G)

((Production of Intermediate Transfer Belt G))

Intermediate Transfer Belt G was produced in the same manner as in Production Example E, except that Conductive Particles A were not used and Dynamic Beads UCN-8070CM Clear (available from Dainichiseika Color & Chemicals Mfg. Co., Ltd., average particle diameter: 7 micrometers) that was spherical polyurethane particles was used instead of Techpolymer SSX102. The volume resistivity of UCN-8070CM Clear was $6.3\times10^{9}$ ohm*cm.

(Production Example H)

((Production of Intermediate Transfer Belt H))

Conductive Particles H were produced in the same manner as in <Production of conductive particles> of Production Example A, except that, in <Production of conductive particles>, Techpolymer SSX102 was replaced with EPOSTAR S6 (available from NIPPON SHOKUBAI CO., LTD., average particle diameter: 0.4 micrometers). The volume resistivity of the particles was $1.6\times10^{1}$ ohm*cm. Intermediate Transfer Belt H was produced in the same manner as in Production Example A, except that Conductive Particles A were replaced with Conductive Particles H.

(Production Example 1)

((Production of Toner 1))

<Preparation of Amorphous Polyester Resin 1>

A four-necked flask equipped with a nitrogen-inlet tube, a dehydration tube, a stirrer, and a thermocouple was charged with a bisphenol A ethylene oxide (2 moles) adduct, a bisphenol A propylene oxide (3 moles) adduct, terephthalic acid, adipic acid, and trimethylolpropane in a manner that a molar ratio between the bisphenol A ethylene oxide (2 moles) adduct and the bisphenol A propylene oxide (3 moles) adduct (bisphenol A ethylene oxide (2 moles) adduct/bisphenol A propylene oxide (3 moles) adduct) was to be 85/15, a molar ratio between the terephthalic acid and the adipic acid (terephthalic acid/adipic acid) was to be 75/25, an amount of the trimethylolpropane in the entire monomers was to be 1 percent by mole, and a molar ratio between hydroxyl groups and carboxyl groups OH/COOH was to be 1.2. The resultant mixture was allowed to react together with titanium tetraisopropoxide (500 ppm relative to the resin component) for 8 hours at 230 degrees Celsius under atmospheric pressure. After further reacting for 4 hours under the reduced pressure of from 10 mmHg through 15 mmHg, trimellitic anhydride was added to the reaction vessel in a manner that the amount of the trimellitic anhydride was to be 1 percent by mole relative to the entire resin component. The resultant mixture was allowed to react for 3 hours at 180 degrees Celsius under atmospheric pressure, to thereby obtain [Amorphous Polyester Resin 1].

<Preparation of Prepolymer>

A reaction vessel equipped with a cooling tube, a stirrer, and a nitrogen-inlet tube was charged with an ethylene oxide 2 moles adduct of bisphenol A, a propylene oxide 2 moles adduct of bisphenol A, terephthalic acid, and adipic acid, together with titanium tetraisopropoxide (1,000 ppm relative to the resin component) in a manner that a molar ratio between hydroxyls group and carboxyl groups OH/COOH was to be 1.1, a diol component was to be composed of 80 percent by mole of the ethylene oxide 2 moles adduct of bisphenol A and 20 percent by mole of the propylene oxide 2 moles adduct of bisphenol A, and a dicarboxylic acid component was to be composed of 60 percent by mole of the terephthalic acid and 40 percent by mole of the adipic acid. Thereafter, the resultant mixture was heated to 200 degrees Celsius for about 4 hours, followed by heating to 230 degrees Celsius for 2 hours. The reaction was performed until generation of effluent was stopped. Thereafter, the resultant was further allowed to react for 5 hours under the reduced pressure of from 10 mmHg through 15 mmHg, to thereby obtain [Intermediate Polyester B-1].

Next, a reaction vessel equipped with a cooling tube, a stirrer, and a nitrogen-inlet tube was charged with the obtained [Intermediate Polyester B-1] and isophorone diisocyanate (IPDI) in a manner that a molar ratio thereof (isocyanate groups of IPDI/hydroxyl groups of intermediate polyester) was to be 2.0. The resultant mixture was diluted with ethyl acetate to make a 50 percent ethyl acetate solution. Then, the resultant solution was allowed to react for 5 hours at 100 degrees Celsius to thereby obtain [Prepolymer 1].

<Preparation of Master Batch (MB)>

Water (1,200 parts), 500 parts of carbon black (Printex 35 available from Degussa AG)[DBP oil absorption=42 mL/100 mg, pH=9.5], and 500 parts of [Amorphous Polyester Resin 1] were blended together. The resultant mixture was mixed by means of Henschel Mixer (available from NIPPON COKE & ENGINEERING CO., LTD.).

The mixture was then kneaded for 30 minutes at 150 degrees Celsius by two rolls, followed by roiling and cooling the kneaded product. The resultant was pulverized by means of a pulverizer, to thereby obtain [Master Batch 1].

<Production of Wax Dispersion Liquid>

A vessel equipped with a stirring rod and a thermometer was charged with 50 parts of paraffin wax (HNP-9, hydrocarbon-based wax, available from NIPPON SEIRO CO., LTD., melting point: 75 degrees Celsius, SP value: 8.8) serving as Release Agent 1 and 450 parts of ethyl acetate. The resultant mixture was heated to 80 degrees Celsius with stirring. After maintaining the temperature at 80 degrees Celsius for 5 hours, the resultant was cooled to 30 degrees Celsius for 1 hour. The resultant was dispersed by means of a bead mill (Ultraviscomill, available from IMEX Co., Ltd.) 3 times under conditions that feeding speed was 1 kg/hr, disk rim speed was 6 msec, and zirconium beads having a diameter of 0.5 mm were packed at 80 percent by volume, to thereby obtain [Wax Dispersion Liquid 1].

<Synthesis of Ketimine Compound>

A reaction vessel equipped with a stirring rod and a thermometer was charged with 170 parts of isophoronediamine and 75 parts of methyl ethyl ketone. The resultant mixture was allowed to react for 5 hours at 50 degrees Celsius, to thereby obtain [Ketimine Compound 1]. The amine value of [Ketimine Compound 1] was 418.

<Preparation of oil phase>

A vessel was charged with 500 parts of [Wax Dispersion Liquid 1], 228 parts of [Prepolymer 1], 836 parts of [Amorphous Polyester Resin 1], 100 parts of [Master Batch 1], and 2 parts of [Ketimine Compound 1] as a curing agent. The resultant mixture was mixed by means of a TK homomixer (available from PRIMIX Corporation) for 60 minutes at 7,000 rpm, to thereby obtain [Oil Phase 1].

<Synthesis of Organic Particle Emulsion (Particle Dispersion Liquid)>

A reaction vessel equipped with a stirring rod and a thermometer was charged with 683 parts of water, 11 parts of a sodium salt of sulfuric acid ester of ethylene oxide addict of methacrylic acid (ELEMINOL RS-30, available from Sanyo Chemical Industries, Ltd.), 138 parts of styrene, 138 parts of methacrylic acid, and 1 part of ammonium persulfate. The resultant mixture was stirred for 15 minutes at 400 rpm to thereby obtain a white emulsion. The obtained emulsion was heated by increasing an internal temperature of the system to 75 degrees Celsius and was allowed to react for 5 hours. Moreover, 30 parts of a 1 percent ammonium persulfate aqueous solution was added to the resultant, and the mixture was matured for 5 hours at 75 degrees Celsius to thereby obtain an aqueous dispersion liquid of a vinyl-based resin (styrene-methacrylic acid-sodium salt of sulfuric acid ester of ethylene oxide addict of methacrylic acid) [Particle Dispersion Liquid 1].

A volume average particle diameter of [Particle Dispersion Liquid 1] measured by LA-920 (HORIBA, Ltd.) was 0.14 micrometers. Part of [Particle Dispersion Liquid 1] was dried to separate the resin component.

<Preparation of Aqueous Phase>

Water (990 parts), 83 parts of [Particle Dispersion Liquid 1], 37 parts of a 48.5 percent sodium dodecyldiphenyl ether disulfonate aqueous solution (ELEMINOL MON-7, available from Sanyo Chemical Industries, Ltd.), and 90 parts of ethyl acetate were mixed and stirred, to thereby obtain a milky white liquid. The obtained liquid was provided as [Aqueous Phase 1].

<Emulsification and Removal or Solvent>

To the vessel charged with [Oil Phase 1], 1,200 parts of [Aqueous Phase 1] was added. The resultant mixture was mixed by a TK homomixer for 20 minutes at the rotational speed of 13,000 rpm, to thereby obtain [Emulsified Slurry 1]. Next, a vessel equipped with a stirrer and a thermometer was charged with [Emulsified Slurry 1] and the solvent was removed for 8 hours at 30 degrees Celsius. Thereafter, the resultant was matured for 4 hours at 45 degrees Celsius, to thereby obtain [Dispersion Slurry 1].

<Washing and Drying>

After filtering 100 parts of [Dispersion Slurry 1] under reduced pressure, the following operations were performed.

(1): To the filtration cake, 100 parts of ion-exchanged water was added, and the mixture was mixed (for 10 minutes at the rotational speed of 12,000 rpm) by TK homomixer, followed by filtering the mixture.

(2): To the filtration cake obtained in (1), 100 parts of a 10 percent sodium hydroxide aqueous solution was added, and the mixture was mixed (for 30 minutes at the rotational speed of 12,000 rpm) by TK homomixer, followed by filtering the mixture under the reduced pressure.

(3): To the filtration cake obtained in (2), 100 parts of 10 percent hydrochloric acid was added, and the mixture was mixed (for 10 minutes at the rotational speed of 12,000 rpm) by TK homomixer, followed by filtering the mixture.

(4): To the filtration cake obtained in (3), 300 parts of ion-exchanged water was added, and the mixture was mixed (for 10 minutes at the rotational speed of 12,000 rpm) by the TK homomixer, followed by filtering the mixture. This series of the operations was performed twice, to thereby obtain [Filtration Cake].

[Filtration Cake] was dried by an air circulation drier for 48 hours at 45 degrees Celsius. The resultant was sieved through a mesh having an opening size of 75 micrometers to thereby obtain [Toner Base Particles 1].

<External Additive Treatment>

To 100 parts of [Toner Base Particles 1], 0.6 parts of hydrophobic silica having an average particle diameter of 100 nm, 1.0 part of titanium oxide having an average particle diameter of 20 nm, 0.8 parts of hydrophobic silica particles having an average diameter of 15 nm were added. The resultant was mixed by 20 L Henschel Mixer (available from MITSUI MINING & SMELTING CO., LTD.) for 5 minutes at rim speed of 50 m/s with circulating 30 percent ethylene glycol water of −5 degrees Celsius through a jacket to cool the inner area of the mixer. The resultant was subjected to air elutriation using a sieve of 500-mesh, to thereby obtain [Toner 1].

(Production Example 2)

((Production of Toner 2))

[Oil Phase 2] was obtained in the same manner as in <Preparation of oil phase> of Production Example 1, except that the mixing conditions were changed to mixing by means of a TK homomixer (available from PRIMIX Corporation) for 60 minutes at 5,000 rpm.

[Toner 2] was obtained in the same manner as in Production Example 1, except that [Oil Phase 1] was replaced with [Oil Phase 2].

(Production Example 3)

((Production of Toner 3))

[Oil Phase 3] was obtained in the same manner as in <Preparation of oil phase> of Production Example 1, except that the amount of [Master Batch 1] was changed to 50 parts.

[Toner 3] was obtained in the same manner as in Production Example 1, except that [Oil Phase 1] was replaced with [Oil Phase 3].

(Production Example 4)

((Production of Toner 4))

[Toner 4] was produced in the same manner as in Production Example 1, except that in <External additive treatment> of Production Example 1 the mixing conditions were changed to mixing for 5 minutes at rim speed of 33 m/s with circulating cold water of 10 degrees Celsius through the jacket.

(Production Example 5)

((Production of Toner 5))

[Toner 5] was produced in the same manner as in Production Example 2, except that in <Emulsification and removal of solvent> of Production Example 2 the mixing performed was changed to mixing by a TK homomixer for 10 minutes at rotational speed of 13,000 rpm to thereby obtained [Emulsified Slurry].

(Production Example 6)

((Production of Toner 6))

[Toner 6] was produced in the same manner as in Production Example 2, except that in <Emulsification and removal of solvent> of Production Example 2 the mixing performed was changed to mixing by a TK homomixer for 30 minutes at rotational speed of 15,000 rpm with cooling using cooling water of 10 degrees Celsius to thereby obtained [Emulsified Slurry].

(Production Example 7)

((Production of Toner 7))

[Oil Phase 4] was obtained in the same manner as in <Preparation of oil phase> of Production Example 1, except that the mixing conditions were changed to mixing by means of a TK homomixer (available from PRIMIX Corporation) for 60 minutes at 3,000 rpm.

[Toner 7] was obtained in the same manner as in Production Example 1, except that [Oil Phase 1] was replaced with [Oil Phase 4].

(Production Example 8)

((Production of Toner 8))

[Toner 8] was obtained in the same manner as in Production Example 1, except that in <External additive treatment> of Production Example 1 the mixing conditions were changed to mixing for 5 minutes at rim speed of 25 m/s with circulating cooling water of 5 degrees Celsius through the jacket.

(Production Example 9)

((Production of Toner 9))

[Toner 9] was produced in the same manner as in Production Example 1, except that in <External additive treatment> of Production Example 1 the mixing conditions were changed to mixing for 5 minutes at rom speed of 40 m/s with circulating cooling water of 10 degrees Celsius through the jacket.

(Production Example 10)

((Production of Toner 10))

[Toner 10] was produced in the same manner as in Production Example 1, except that in <Preparation of oil phase> of Production Example 1, the mixing conditions were changed to mixing by a TK homomixer (available from PRIMIX Corporation) for 60 minutes at 3,000 rpm to obtain [Oil Phase 5] and in <External additive treatment> of Production Example 1, the mixing conditions were changed to mixing for 5 minutes at rim speed of 40 m/s with circulating cooling water of 10 degrees Celsius through the jacket.

Example 1

((Production of Carrier))

To 100 parts by mass of toluene, 100 parts by mass of a silicone resin (organo straight silicone), 5 parts by mass of gamma-(2-aminoethyl)aminopropyltrimethoxysilane, and 10 parts by mass of carbon black were added. The resultant mixture was dispersed by a homomixer for 20 minutes to prepare a resin layer coating liquid. The resin layer coating liquid was applied on surfaces of spherical magnetite particles (1,000 parts by mass) having an average particle diameter of 50 micrometers by means of a fluidized bed coating device, to thereby produce [Carrier].

((Production of Developer))

By means of a ball mill, 5 parts by mass of [Toner 1] and 95 parts by mass of [Carrier] were mixed to thereby produce [Developer 1].

Next, an image forming apparatus was constructed using Developer 1 and Intermediate Transfer Belt A and properties were evaluated in the following manner. The results are presented in Tables 1-1 to 1-3.

<Transfer Properties>

The developer and the intermediate transfer belt were mounted in the image forming apparatus of FIG. 5 and surface-coated thick paper (POD gloss coat paper) was prepared as paper having low half-tone transfer properties. Next, a black single color half-tone image was output with each of a monochrome mode (low transfer electric current) and a full-color mode (high transfer electric current) and transfer properties of the toner was confirmed.

—Evaluation Criteria of Transfer Properties—

The judgement was performed according to the following criteria.

Very good: The transfer rate was 90 percent or greater.

Good: The transfer rate was 80 percent or greater but less than 90 percent.

Fair: The transfer rate was 70 percent or greater but less than 80 percent.

Poor: The transfer rate was less than 70 percent.

<Cleaning Properties>

Moreover, cleaning properties of the intermediate transfer belt were evaluated.

After performing the test of the transfer properties with the full-color mode (high transfer electric current), a fibrous tape was adhered onto the surface of the belt to collect the toner remained on the belt. The amount of the collected toner was measured and was evaluated based on the following criteria.

—Evaluation Criteria of Cleaning Properties—

The judgement was performed according to the following criteria.

Good: Less than 0.1 g

Fair: 0.1 g or greater but less than 0.5 g

Poor: 1.0 g or greater

<Image Density (Coloring Degree)>

The following evaluation was performed using Developer 1 produced and Intermediate Transfer Belt A. After charging a unit of imageo MP C4300 (available form Ricoh Company Limited) with the developer, a rectangular solid image of 2 cm×15 cm was formed on a PPC sheet type 6000<70W>A4 grain long (available form Ricoh Company Limited) in a manner that a deposition amount of the toner was to be 0.40 mg/cm$^2$. During the formation of the solid image, a surface temperature of a fixing roller was set to 120 degrees Celsius. Next, the image density (ID) of the solid image was measured by means of X-Rite938 (X-Rite Inc.) with the status A mode and d50 light.

—Evaluation Criteria—

Very good: 1.5 or greater

Good: 1.4 or greater but less than 1.5

Fair: 1.2 or greater but less than 1.4

Poor: less than 1.2

Examples 2 to 10 and Comparative Examples 1 to 7

Evaluations of image formation were performed in the same manner as in Example 1, except that the toner and the intermediate transfer belt presented in Tables 1-1 and 1-2 were used. The results are presented in Tables 1-1 to 1-3.

TABLE 1-1

| | Belt | Volume resistivity of particles (Ω · cm) | Surface resistivity of belt (Ω/□) | Volume resistivity of belt (Ω · cm) |
|---|---|---|---|---|
| Example | 1 A | $2.1 \times 10^{2}$ | $1.6 \times 10^{11}$ | $8.4 \times 10^{9}$ |
| | 2 B | $7.5 \times 10^{0}$ | $1.5 \times 10^{11}$ | $8.3 \times 10^{9}$ |
| | 3 C | $7.5 \times 10^{8}$ | $1.7 \times 10^{11}$ | $8.5 \times 10^{9}$ |
| | 4 D | $5.5 \times 10^{5}$ | $1.7 \times 10^{11}$ | $8.4 \times 10^{9}$ |
| | 5 C | $7.5 \times 10^{8}$ | $1.7 \times 10^{11}$ | $8.5 \times 10^{9}$ |
| | 6 C | $7.5 \times 10^{8}$ | $1.7 \times 10^{11}$ | $8.5 \times 10^{9}$ |
| | 7 C | $7.5 \times 10^{8}$ | $1.7 \times 10^{11}$ | $8.5 \times 10^{9}$ |
| | 8 C | $7.5 \times 10^{8}$ | $1.7 \times 10^{11}$ | $8.5 \times 10^{9}$ |
| | 9 C | $7.5 \times 10^{8}$ | $1.7 \times 10^{11}$ | $8.5 \times 10^{9}$ |
| | 10 H | $1.6 \times 10^{1}$ | $1.5 \times 10^{11}$ | $8.5 \times 10^{9}$ |
| Comparative Example | 1 E | $>1 \times 10^{14}$ | $1.2 \times 10^{11}$ | $8.4 \times 10^{9}$ |
| | 2 F | $3.2 \times 10^{-6}$ | $1.6 \times 10^{11}$ | $8.3 \times 10^{9}$ |
| | 3 G | $6.3 \times 10^{9}$ | $1.6 \times 10^{11}$ | $8.4 \times 10^{9}$ |
| | 4 A | $2.1 \times 10^{2}$ | $1.6 \times 10^{11}$ | $8.4 \times 10^{9}$ |
| | 5 C | $7.5 \times 10^{8}$ | $1.7 \times 10^{11}$ | $8.5 \times 10^{9}$ |
| | 6 C | $7.5 \times 10^{8}$ | $1.7 \times 10^{11}$ | $8.5 \times 10^{9}$ |
| | 7 E | $>1 \times 10^{14}$ | $1.2 \times 10^{11}$ | $8.4 \times 10^{9}$ |

TABLE 1-2

| | | Toner | Volume average particle diameter (μm) | Average circularity | Dielectric constant | Liberation rate of additives (mass %) |
|---|---|---|---|---|---|---|
| Example | 1 | 1 | 5.2 | 0.962 | 3.5 | 22 |
| | 2 | 1 | 5.2 | 0.962 | 3.5 | 22 |
| | 3 | 1 | 5.2 | 0.962 | 3.5 | 22 |
| | 4 | 1 | 5.2 | 0.962 | 3.5 | 22 |
| | 5 | 2 | 5.7 | 0.966 | 3.8 | 28 |
| | 6 | 3 | 6.5 | 0.970 | 2.8 | 26 |
| | 7 | 4 | 5.3 | 0.961 | 3.4 | 30 |
| | 8 | 5 | 6.0 | 0.972 | 3.9 | 33 |
| | 9 | 6 | 4.0 | 0.937 | 3.7 | 24 |
| | 10 | 5 | 6.0 | 0.972 | 3.9 | 33 |
| Comparative Example | 1 | 1 | 5.2 | 0.962 | 3.5 | 22 |
| | 2 | 1 | 5.2 | 0.962 | 3.5 | 22 |
| | 3 | 1 | 5.2 | 0.962 | 3.5 | 22 |
| | 4 | 7 | 4.5 | 0.975 | 4.3 | 31 |
| | 5 | 8 | 5.1 | 0.960 | 3.4 | 40 |
| | 6 | 9 | 5.0 | 0.959 | 3.6 | 15 |
| | 7 | 10 | 6.0 | 0.980 | 4.5 | 14 |

TABLE 1-3

| | | Monochrome mode half tone transfer properties | Full color mode half tone transfer properties | Cleaning properties | Image density |
|---|---|---|---|---|---|
| Example | 1 | Very good | Very good | Good | Very good |
| | 2 | Good | Good | Good | Very good |
| | 3 | Good | Good | Good | Very good |
| | 4 | Good | Good | Fair | Very good |
| | 5 | Fair | Good | Good | Good |
| | 6 | Very good | Good | Good | Fair |
| | 7 | Good | Good | Good | Very good |
| | 8 | Good | Good | Fair | Good |
| | 9 | Fair | Fair | Fair | Very good |
| | 10 | Very good | Very good | Fair | Very good |
| Comparative Example | 1 | Fair | Poor | Good | Good |
| | 2 | Poor | Poor | Good | Good |
| | 3 | Fair | Poor | Good | Good |
| | 4 | Poor | Fair | Poor | Fair |
| | 5 | Fair | Poor | Good | Good |
| | 6 | Fair | Fair | Poor | Good |
| | 7 | Poor | Poor | Poor | Good |

The following facts were confirmed from the results above. The volume resistivity of the particles varied from the order of $-6^{th}$ power through $14^{th}$ power, but the resistivity of the intermediate transfer belt itself did not change in the measurements. However, there was a significant difference in the transfer properties of the half-tone between Intermediate Transfer Belts A to D and H and Intermediate Transfer Belts E and G that had the higher volume resistivity of the particles than the volume resistivity of the particles in Intermediate Transfer Belts A to D and H. Particularly, the difference was significant in the full-color mode. On the other hand, the toner could not be transferred at all with Intermediate Transfer Belt F that had the lower volume resistivity of the particles than the volume resistivity of the particles in Intermediate Transfer Belts A to D. It was found from the results as mentioned that the half-tone transfer properties were not desirable with both high and low volume resistivity of the particles. As a result of performing the test of transfer properties using Toner 8, it was found that the transfer properties were gradually deteriorated. After the test, the intermediate transfer belt was observed under a microscope and cracking in the surface of the belt and the depositions of the additive were observed. Therefore, it is assumed that the separated additive may scrape the surface of the belt or degrade transfer properties.

As demonstrated in Examples above, the present disclosure can provide an image forming apparatus having excellent transfer properties even when a special transfer medium is used, having excellent half-tone transfer properties with a full-color mode, and having excellent cleaning properties.

For example, embodiments of the present disclosure are as follows.

<1> An image forming apparatus including:

an image bearer where a latent image is to be formed on the image bearer and the image bearer can bear a toner image;

a developing unit configured to develop a latent image formed on the image bearer with a toner to form the toner image;

an intermediate transfer member, on which the toner image formed through the development performed by the developing unit is primary transferred; and a transferring unit configured to secondary transfer the toner image born on the intermediate transfer member to a recording medium, wherein the intermediate transfer member includes a laminate including a base layer and an elastic layer, the elastic layer includes particles at a surface of the elastic layer to form convex-concave shapes at the surface, the particles have volume resistivity of from $1\times10^{0}$ ohm*cm through $1\times10^{9}$ ohm*cm, the toner includes an additive, an amount of the additive separated from the toner is from 20 percent by mass through 35 percent by mass relative to a total amount of the additive in the toner, when a toner dispersion liquid in which the toner is dispersed in a dispersant is irradiated with ultrasonic wave vibration with an irradiation energy dose of 4 kJ, and the toner has a dielectric constant of 2.6 or greater but 3.9 or less.

<2> The image forming apparatus according to <1>, wherein the particles are spherical particles.

<3> The image forming apparatus according to <1> or <2>, wherein the volume resistivity of the particles is from $1\times10^{1}$ ohm*cm through $1\times10^{3}$ ohm*cm.

<4> The image forming apparatus according to <2>, wherein an average particle diameter of the spherical particles is 5 micrometers or less.

<5> The image forming apparatus according to any one of <1> to <4>, wherein the intermediate transfer member is a seamless intermediate transfer belt.

<6> The image forming apparatus according to any one of <1> to <5>, wherein a volume average particle diameter of the toner is from 3 micrometers through 7 micrometers.

<7> The image forming apparatus according to any one of <1> to <6>, wherein an average circularity of the toner is from 0.925 through 0.970.

<8> The image forming apparatus according to any one of <1> to <7>, wherein the image forming apparatus is a full-color image forming apparatus and the image forming apparatus includes a plurality of the image bearers each including the developing unit of each color where the image bearers are arranged in series.

<9> An image forming method including:

developing a latent image formed on an image bearer with a toner to form the toner image, where the image bearer is an image bearer capable of bearing a toner image;

primary transferring the toner image developed in the developing to an intermediate transfer member; and secondary transferring the toner image born on the intermediate transfer member to a recording medium, wherein the intermediate transfer member includes a laminate including a base layer and an elastic layer, the elastic layer includes particles at a surface of the elastic layer to form convex-concave shapes at the surface, the particles have volume resistivity of from $1\times10^0$ ohm*cm through $1\times10^9$ ohm*cm, the toner includes an additive, an amount of the additive separated from the toner is from 20 percent by mass through 35 percent by mass relative to a total amount of the additive in the toner, when a toner dispersion liquid in which the toner is dispersed in a dispersant is irradiated with ultrasonic wave vibration with an irradiation energy dose of 4 kJ, and the toner has a dielectric constant of 2.6 or greater but 3.9 or less.

<10> The image forming method according to <9>, wherein the particles are spherical particles.

<11> The image forming method according to <9> or <10>, wherein the volume resistivity of the particles is from $1\times10^1$ ohm*cm through $1\times10^3$ ohm*cm.

<12> The image forming method according to <10>, wherein an average particle diameter of the spherical particles is 5 micrometers or less.

<13> The image forming method according to any one of <9> to <12>, wherein the intermediate transfer member is a seamless intermediate transfer belt.

<14> The image forming method according to any one of <9> to <13>, wherein a volume average particle diameter of the toner is from 3 micrometers through 7 micrometers.

<15> The image forming apparatus according to any one of <9> to <14>, wherein an average circularity of the toner is from 0.925 through 0.970.

The image forming apparatus according to <1> to <8> and the image forming method according to <9> to <15> can solve the above-described various problems existing in the art and can achieve the object of the present disclosure.

INDUSTRIAL APPLICABILITY

For example, the image forming apparatus of the present disclosure is used as an image forming apparatus, such as copiers and printers. Particularly, the image forming apparatus of the present disclosure is suitably used as an image forming apparatus that performs full-color image formation.

The invention claimed is:

1. An image forming apparatus comprising:

an image bearer where a latent image is to be formed on the image bearer and the image bearer can bear a toner image;

a developing unit configured to develop a latent image formed on the image bearer with a toner to form the toner image;

an intermediate transfer member, on which the toner image formed through the development performed by the developing unit is primary transferred; and a transferring unit configured to secondary transfer the toner image born on the intermediate transfer member to a recording medium, wherein the intermediate transfer member includes a laminate including a base layer and an elastic layer, the elastic layer includes particles at a surface of the elastic layer to form convex-concave shapes at the surface, the particles have volume resistivity of from $1\times10^0$ ohm*cm through $1\times10^9$ ohm*cm, the toner includes an additive, an amount of the additive separated from the toner is from 20 percent by mass through 35 percent by mass relative to a total amount of the additive in the toner, when a toner dispersion liquid in which the toner is dispersed in a dispersant is irradiated with ultrasonic wave vibration with an irradiation energy dose of 4 kJ, and the toner has a dielectric constant of 2.6 or greater but 3.9 or less.

2. The image forming apparatus according to claim 1, wherein the particles are spherical particles.

3. The image forming apparatus according to claim 2, wherein an average particle diameter of the spherical particles is 5 micrometers or less.

4. The image forming apparatus according to claim 1, wherein the volume resistivity of the particles is from $1\times10^1$ ohm*cm through $1\times10^3$ ohm*cm.

5. The image forming apparatus according to claim 1, wherein the intermediate transfer member is a seamless intermediate transfer belt.

6. The image forming apparatus according to claim 1, wherein a volume average particle diameter of the toner is from 3 micrometers through 7 micrometers.

7. The image forming apparatus according to claim 1, wherein an average circularity of the toner is from 0.925 through 0.970.

8. The image forming apparatus according to claim 1, wherein the image forming apparatus is a full-color image forming apparatus and the image forming apparatus includes a plurality of the image bearers arranged in series and includes a plurality of the developing units corresponding to the plurality of the image bearers.

9. An image forming method comprising:

developing a latent image formed on an image bearer with a toner to form the toner image, where the image bearer is an image bearer capable of bearing a toner image;

primary transferring the toner image developed in the developing to an intermediate transfer member; and secondary transferring the toner image born on the intermediate transfer member to a recording medium, wherein the intermediate transfer member includes a laminate including a base layer and an elastic layer, the elastic layer includes particles at a surface of the elastic layer to form convex-concave shapes at the surface, the particles have volume resistivity of from $1\times10^0$ ohm*cm through $1\times10^9$ ohm*cm, the toner includes an additive, an amount of the additive separated from the toner is from 20 percent by mass through 35 percent by mass relative to a total amount of the additive in the toner, when a toner dispersion liquid in which the toner is dispersed in a dispersant is irradiated with ultrasonic wave vibration with an irradiation energy dose of 4 kJ, and the toner has a dielectric constant of 2.6 or greater but 3.9 or less.

10. The image forming method according to claim 9, wherein the particles are spherical particles.

11. The image forming method according to claim 10, wherein an average particle diameter of the spherical particles is 5 micrometers or less.

12. The image forming method according to claim 9, wherein the volume resistivity of the particles is from $1\times10^{1}$ ohm*cm through $1\times10^{3}$ ohm*cm.

13. The image forming method according to claim 9, wherein the intermediate transfer member is a seamless intermediate transfer belt.

14. The image forming method according to claim 9, wherein a volume average particle diameter of the toner is from 3 micrometers through 7 micrometers.

15. The image forming apparatus according to claim 9, wherein an average circularity of the toner is from 0.925 through 0.970.

* * * * *